US009483005B2

(12) United States Patent
Kobayashi

(10) Patent No.: US 9,483,005 B2
(45) Date of Patent: Nov. 1, 2016

(54) MEDIUM CARRYING DEVICE AND IMAGE FORMING APPARATUS

(71) Applicant: Oki Data Corporation, Tokyo (JP)

(72) Inventor: Takashi Kobayashi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/638,596

(22) Filed: Mar. 4, 2015

(65) Prior Publication Data

US 2015/0177669 A1 Jun. 25, 2015

Related U.S. Application Data

(63) Continuation of application No. 14/167,659, filed on Jan. 29, 2014, now Pat. No. 8,998,204.

(30) Foreign Application Priority Data

Jan. 31, 2013 (JP) ..... 2013-016756

(51) Int. Cl.
*B65H 5/06* (2006.01)
*G03G 15/00* (2006.01)
(Continued)

(52) U.S. Cl.
CPC ..... *G03G 15/6529* (2013.01); *B65H 5/06* (2013.01); *B65H 5/062* (2013.01); *B65H 5/38* (2013.01); *B65H 7/02* (2013.01); *B65H 9/00* (2013.01); *B65H 9/006* (2013.01); *B65H 9/04* (2013.01); *B65H 9/08* (2013.01); *B65H 85/00* (2013.01); *G03G 21/1695* (2013.01); *B65H 2402/31* (2013.01); *B65H 2402/32* (2013.01); *B65H 2402/441* (2013.01); *B65H 2404/144* (2013.01); *B65H 2404/1521* (2013.01); *B65H 2404/1522* (2013.01); *B65H 2404/6111* (2013.01); *B65H 2511/20* (2013.01); *B65H 2511/414* (2013.01); *B65H 2511/51* (2013.01); *B65H 2513/53* (2013.01); *B65H 2801/09* (2013.01);
(Continued)

(58) Field of Classification Search
CPC ..... B65H 5/062; B65H 5/068; B65H 5/36; B65H 29/125; B65H 29/52; B65H 2404/142; B65H 2404/143; B65H 2404/611; B65H 2404/74; B65H 2553/612
USPC ..... 271/272, 273, 274, 314, 258.01, 271/265.01, 264
See application file for complete search history.

(56) References Cited

U.S. PATENT DOCUMENTS 5,236,339 A 8/1993 Nishiumi et al.
5,265,869 A 11/1993 Morita
(Continued)

FOREIGN PATENT DOCUMENTS

JP H06-348088 A 12/1994
JP H09-249337 A 9/1997
(Continued)

*Primary Examiner* — David H Bollinger
(74) *Attorney, Agent, or Firm* — Muncy, Geissler, Olds & Lowe, P.C.

(57) ABSTRACT

A medium carrying device includes an apparatus body, medium guide unit that is detachable with respect to the apparatus body, a carrying roller that is disposed in the apparatus body, and is configured to rotate to carry a print medium passing through the medium guide unit, and a driven roller that is disposed in the medium guide unit at a position corresponding to the carrying roller in a contacting manner so that the driven roller rotates in accordance with a rotation of the carrying roller.

21 Claims, 34 Drawing Sheets

(51) Int. Cl.

| | |
|---|---|
| ***B65H 85/00*** | (2006.01) |
| ***B65H 5/38*** | (2006.01) |
| ***B65H 7/02*** | (2006.01) |
| ***B65H 9/00*** | (2006.01) |
| ***B65H 9/04*** | (2006.01) |
| ***B65H 9/08*** | (2006.01) |
| *G03G 15/23* | (2006.01) |
| *G03G 21/16* | (2006.01) |

(52) U.S. Cl.

CPC ..... *G03G15/234* (2013.01); *G03G 15/6567* (2013.01); *G03G 15/6573* (2013.01); *G03G 21/1623* (2013.01); *G03G 21/1638* (2013.01); *G03G 2215/0054* (2013.01); *G03G 2215/00544* (2013.01); *G03G 2215/00675* (2013.01); *G03G 2215/00679* (2013.01)

(56) References Cited

U.S. PATENT DOCUMENTS

| | | | |
|---|---|---|---|
| 6,540,224 | B2 | 4/2003 | Luther |
| 6,857,631 | B2 | 2/2005 | Morrison et al. |
| 6,978,998 | B2 | 12/2005 | Zheng |
| 7,548,723 | B2 | 6/2009 | Kang |
| 7,950,659 | B2 | 5/2011 | Matsushima |
| 7,954,803 | B2 | 6/2011 | Kitagawa et al. |
| 8,083,230 | B2 | 12/2011 | Spence |
| 8,317,196 | B2 | 11/2012 | Tanaka et al. |
| 8,336,878 | B2 | 12/2012 | Tozaki et al. |
| 8,454,014 | B2 | 6/2013 | Kotera |
| 8,457,526 | B2 | 6/2013 | Takagi |
| 2001/0042957 | A1 | 11/2001 | Luther |
| 2010/0194027 | A1 | 8/2010 | Takagi |
| 2011/0156341 | A1 | 6/2011 | Fujita |
| 2011/0227272 | A1 | 9/2011 | Kotera |

FOREIGN PATENT DOCUMENTS

| | | | |
|---|---|---|---|
| JP | 2001-183954 | A | 7/2001 |
| JP | 2002-167077 | A | 6/2002 |
| JP | 2004-277182 | A | 10/2004 |
| JP | 2007-022687 | A | 2/2007 |
| JP | 2007-039250 | A | 2/2007 |
| JP | 2007-316187 | A | 12/2009 |
| JP | 2010-222085 | A | 10/2010 |

MEDIUM CARRYING DEVICE AND IMAGE FORMING APPARATUS

CROSS REFERENCE TO RELATED APPLICATION

This application is a Continuation of co-pending application Ser. No. 14/167,659, filed on Jan. 29 2014, for which priority is claimed under 35 U.S.C. §120; and this application claims priority of Application No. 2013-016756 filed in Japan on Jan. 31, 2013 under 35 U.S.C. §119; the entire contents of all of which are hereby incorporated by reference.

TECHNICAL FIELD

The present invention relates to a medium carrying device and an image forming apparatus.

BACKGROUND

Conventionally, in an image forming apparatus such as a printer, a copying machine, a facsimile or a multifunction machine, for example, in a printer, an image forming unit, an LED head, a transfer roller, a fixing unit, a sheet sheet cassette and the like are provided. In the image forming unit, a photoreceptor drum, a charging roller, a developing roller, a developer blade, a toner supply roller, a cleaning blade, a toner cartridge and the like are arranged.

In the image forming unit, a surface of the photoreceptor drum that is uniformly charged by the charging roller is exposed by the LED head and an electrostatic latent image is formed. Further, a toner that is supplied from the toner cartridge to a body of the image forming unit, that is, to an image forming unit body, is supplied to the developing roller by the toner supply roller, and the toner on the developing roller is caused to form a thin layer by the developer blade. Next, the toner on the developing roller is attached to the electrostatic latent image on the photoreceptor drum, and the electrostatic latent image is developed and a toner image is formed on the photoreceptor drum.

A sheet as a print medium brought out from the sheet cassette is sent to a transfer part formed between the photoreceptor drum and the transfer roller. After a toner image is transferred by the transfer roller at the transfer part, the sheet is sent to the fixing unit. At the fixing unit, the toner image is fixed onto the sheet and an image is formed on the paper.

However, a printer is provided that includes a duplex printing unit as a standard equipment so that duplex printing can be performed by forming images on both sides of a paper.

In the printer of this kind, a medium carrying device for carrying the sheet is provided with a reversing part, at a position above the sheet cassette and in a vicinity of the fixing unit, for reversing the paper, and a reversed medium carrying part, at a position above the sheet cassette and on a side opposite to the fixing unit, for sending the reversed sheet again to the transfer part (for example, see Japanese Patent Laid-Open Publication No. 2010-222085).

However, in the conventional printer, operability for insertion and removal of a medium guide unit is not high.

A purpose of specific examples described in the present invention is to improve the operability for insertion and removal of the medium guide unit.

SUMMARY

A medium carrying device disclosed in the application includes an apparatus body, medium guide unit that is detachable with respect to the apparatus body, a carrying roller that is disposed in the apparatus body, and is configured to rotate to carry a print medium passing through the medium guide unit, and a driven roller that is disposed in the medium guide unit at a position corresponding to the carrying roller in a contacting manner so that the driven roller rotates in accordance with a rotation of the carrying roller.

In the specific examples described in the present invention, the operability for insertion and removal of the medium guide unit is improved.

DETAILED DESCRIPTION OF EMBODIMENTS

In the following, embodiments of the present invention are described in detail with reference to the drawings. In this case, a printer as an image forming apparatus is described.

Figure 2:
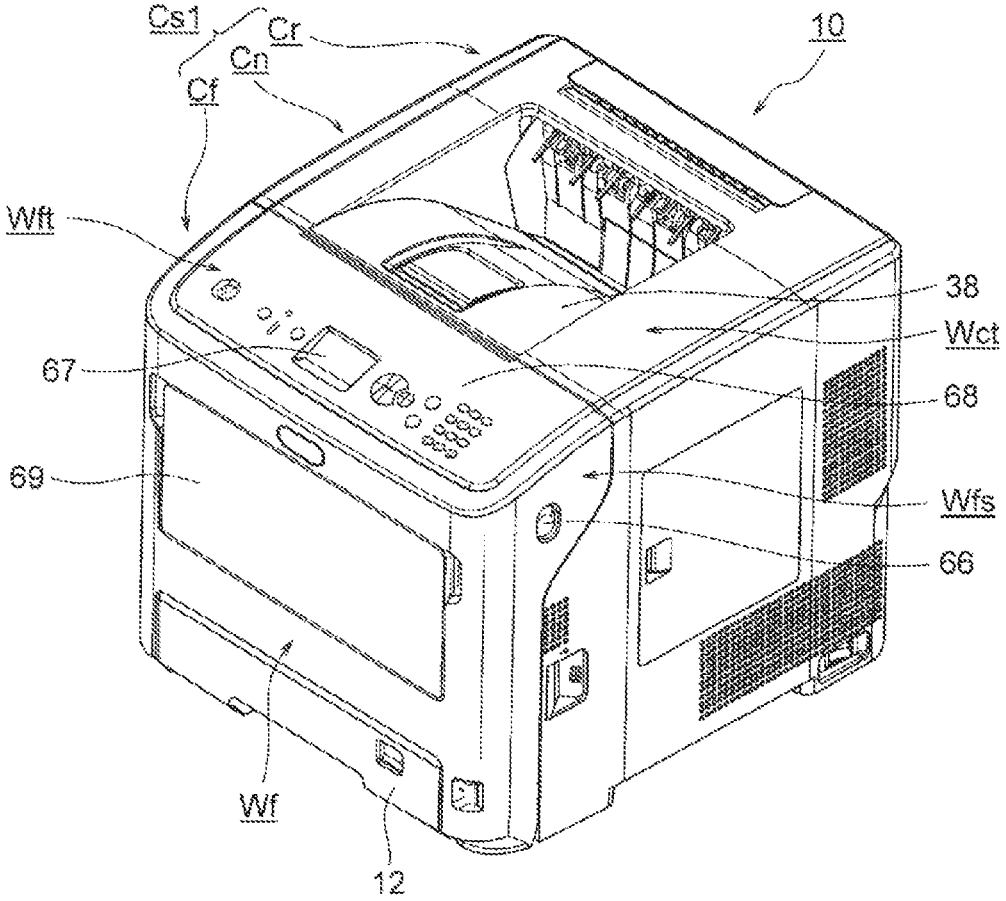
FIG. 2 illustrates a perspective view illustrating an external appearance of the printer in the first embodiment of the present invention.
Figure 3:
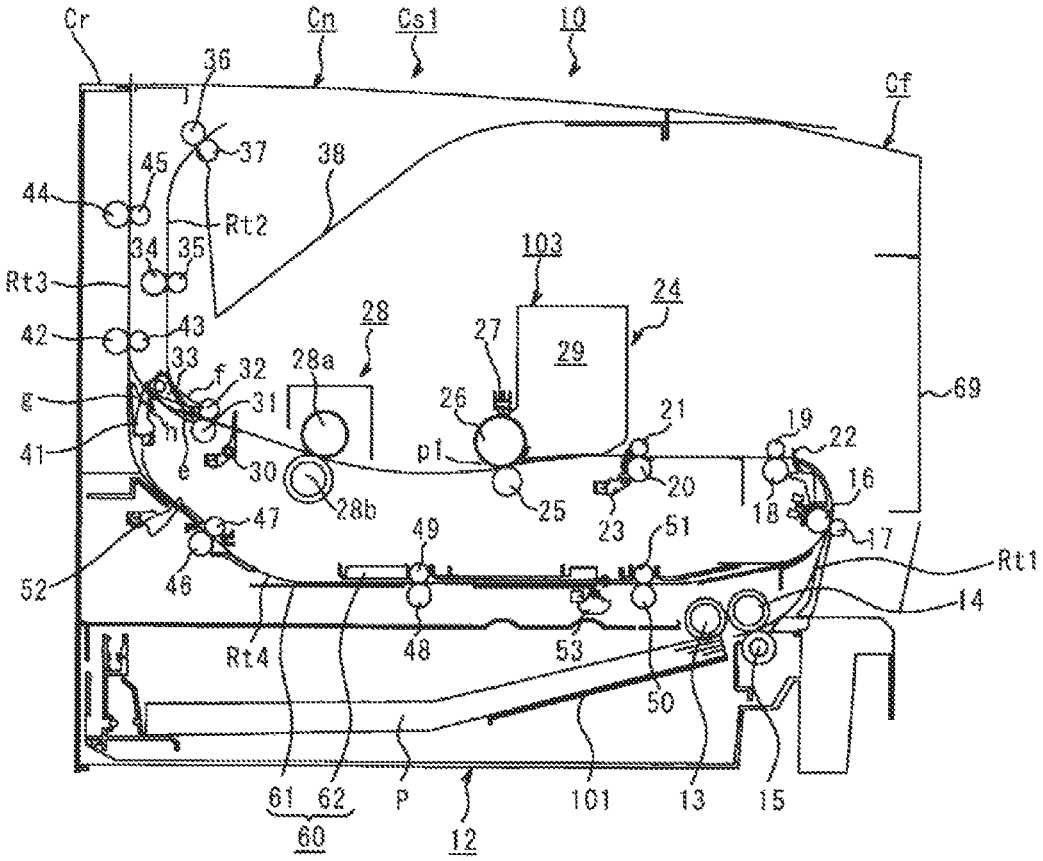
FIG. 3 illustrates a schematic diagram of the printer in the first embodiment of the present invention.
Figure 4:
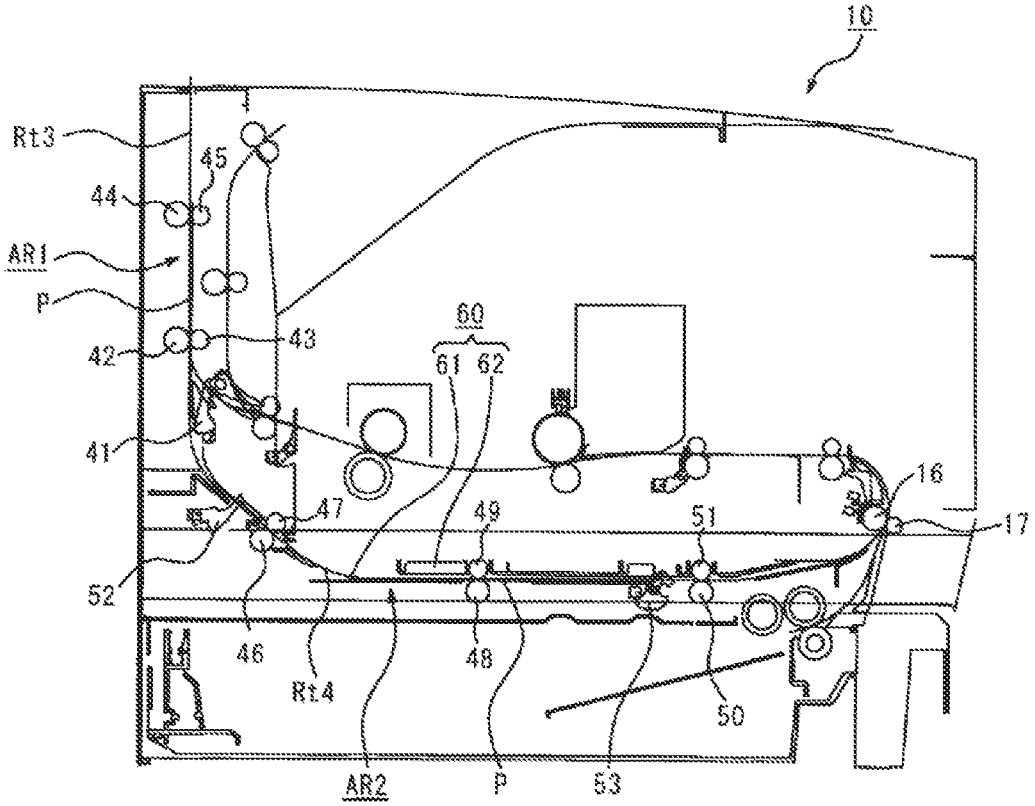
FIG. 4 illustrates a diagram for describing a duplex printing unit in the first embodiment of the present invention.
Figure 5:
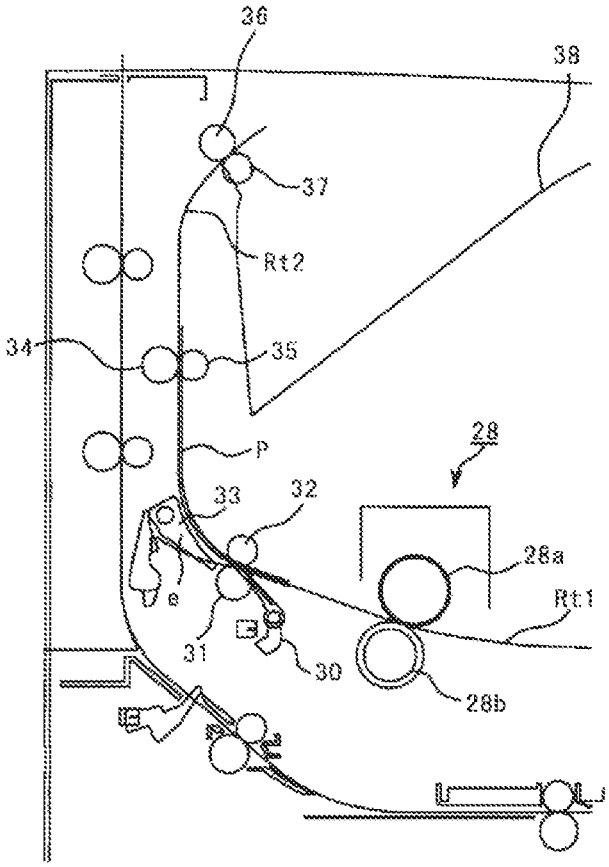
FIG. 5 is a diagram for describing an operation of the printer when performing simplex printing in the first embodiment of the present invention.
Figure 6:
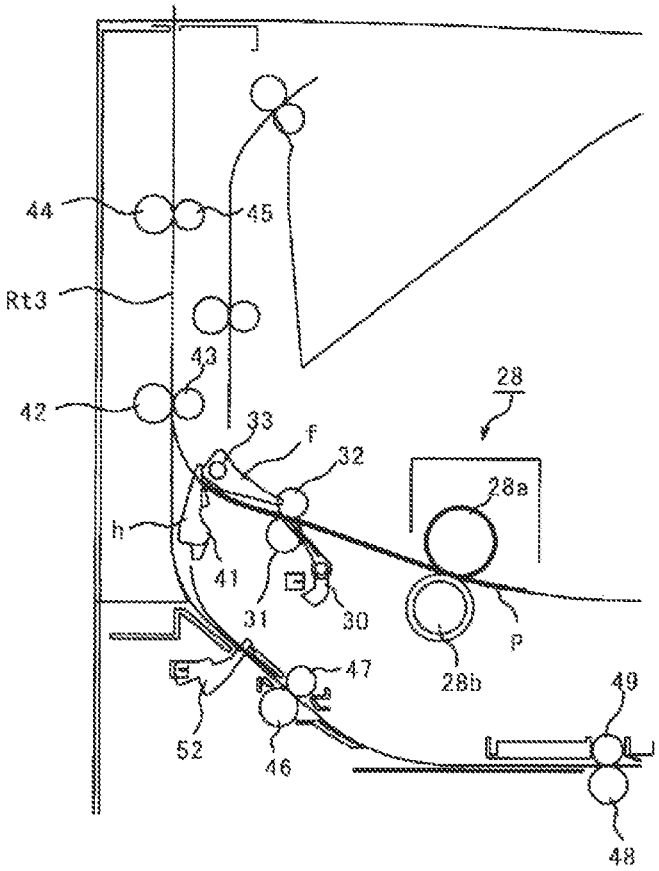
FIG. 6 illustrates a first diagram for describing an operation of the printer when performing duplex printing in the first embodiment of the present invention.
Figure 7:
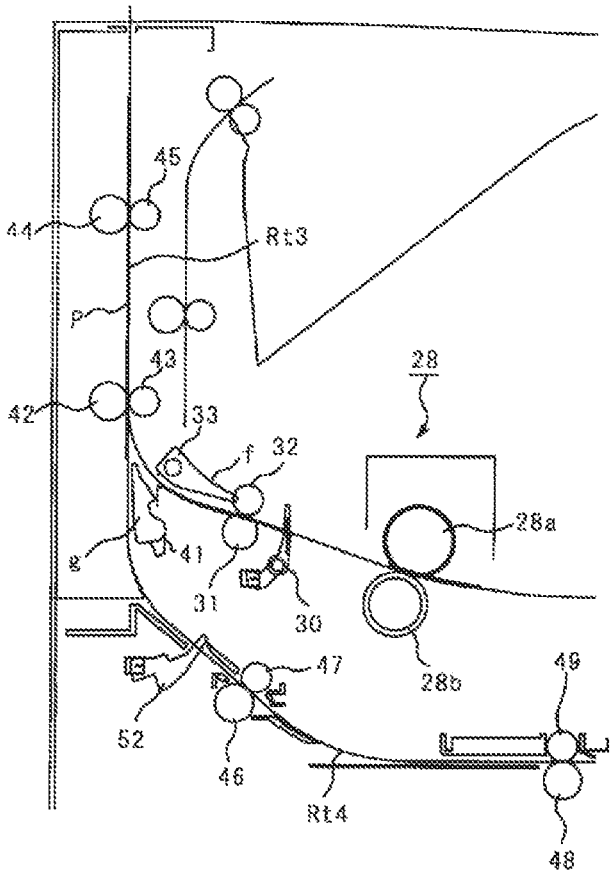
FIG. 7 illustrates a second diagram for describing the operation of the printer when performing duplex printing in the first embodiment of the present invention.
Figure 8:
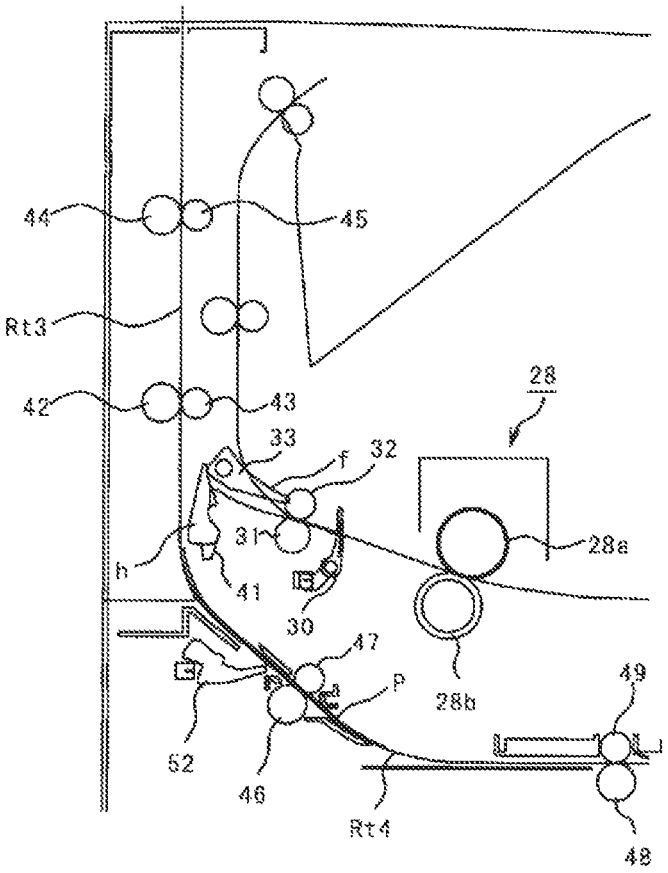
FIG. 8 illustrates a third diagram for describing the operation of the printer when performing duplex printing in the first embodiment of the present invention.

FIG. 2 illustrates a perspective view illustrating an external appearance of a printer in a first embodiment of the present invention. FIG. 3 illustrates a schematic diagram of the printer in the first embodiment of the present invention. FIG. 4 illustrates a diagram for describing a duplex printing unit in the first embodiment of the present invention. FIG. 5 is a diagram for describing an operation of the printer when performing simplex printing in the first embodiment of the present invention. FIG. 6 illustrates a first diagram for describing an operation of the printer when performing duplex printing in the first embodiment of the present invention. FIG. 7 illustrates a second diagram for describing the operation of the printer when performing duplex printing in the first embodiment of the present invention. FIG. 8 illustrates a third diagram for describing the operation of the printer when performing duplex printing in the first embodiment of the present invention.

In the drawings, a reference numeral symbol 10 denotes a printer. A reference numeral symbol Cs1 denotes a casing of the printer 10. The casing Cs1 includes a central casing part Cn as a first casing part that is arranged at a center of the printer 10, a front casing part Cf as a second casing part that is swingably and openably/closably arranged with respect to the central casing part Cn in front of the central casing part Cn, and a rear casing part Cr as a third casing part that is detachably arranged with respect to the central casing part Cn in rear of the central casing part Cn.

Further, a reference numeral symbol 12 denotes a sheet cassette as a medium housing part that is arranged at a bottom of the printer 10 to extend from a front casing part Cf side, that is, a front side, of the printer 10 to a rear casing part Cr side, that is, a rear side, and to house a sheet P as a medium. A reference numeral symbol 38 denotes a stacker that is formed on a top wall Wct of the central casing part Cn for stacking a sheet P on which an image is formed and that is discharged out from a body of the printer 10, that is, from an apparatus body. A reference numeral symbol 67 denotes an operation panel as a display that is formed on a top wall Wft of the front casing part Cf. A reference numeral symbol 68 denotes a control panel as an operation part that is formed adjacent to the operation panel 67 on the top wall Wft. A reference numeral symbol 69 denotes a MPT tray as a medium stacking part that is swingably formed on a central part of a front wall Wf of the front casing part Cf for manually supplying the sheet P of various sizes. A reference numeral symbol 66 denotes a lock lever as a releasing operation part that is formed on a side wall Wfs on a right side of the front casing part Cf for releasing a lock when opening the front casing part Cf.

On a front end portion of the sheet cassette 12, a sheet feeding roller 13, a sheet feeding sub-roller 14 and a separation roller 15 are arranged. The sheet feeding roller 13 is rotatably arranged and brings out one by one the sheet P that is stacked on a medium stacking plate 101 in the sheet cassette 12. The sheet feeding sub-roller 14 as a first discrimination roller is rotatably arranged adjacent to the sheet feeding roller 13. The separation roller 15 as a second discrimination roller is rotatably arranged opposing the sheet feeding sub-roller 14. The sheet feeding sub-roller 14 and the separation roller 15 separate one by one the sheet P brought out by the sheet feeding roller 13 and supply the sheet P to a medium carrying route Rt1, and configure a discrimination device.

Further, in the medium carrying route Rt1, on a downstream side of the sheet feeding sub-roller 14 and the separation roller 15, an intermediate carrying roller 16 and a pinch roller 17 are arranged as a first carrying member carrying the sheet P. On a downstream side of the intermediate carrying roller 16 and the pinch roller 17, a sensor lever 22 is arranged as a first medium detection part for detecting a front end of the sheet P. On a downstream side of the sensor lever 22, a resist roller 18 and a pressure roller 19 are arranged as a second carrying member that corrects a skew of the sheet P. On a downstream side of the resist roller 18 and the pressure roller 19, an intermediate carrying roller 20 and a pressure roller 21 are arranged as a third carrying member carrying the sheet P. On a downstream side of the intermediate carrying roller 20 and the pressure roller 21, a sensor lever 23 is arranged as a second medium detection part for detecting the front end of the sheet P.

The sensor lever 22 detects the sheet P by being brought down along with passing of the sheet P, and a position signal indicating a position of the sheet P is sent to a controller (not illustrated in the drawings) from a sensor (not illustrated in the drawings) that is arranged as a detection output part adjacent to the sensor lever 22. Further, the sensor lever 23 detects the sheet P by being brought down along with passing of the sheet P, and a write signal is sent from a sensor (not illustrated in the drawings) as a detection output part that is arranged adjacent to the sensor lever 23 to the controller. Upon receiving the write signal, the controller sends an instruction for forming an image on the sheet P to an image forming part 103.

In the medium carrying route Rt1, on a downstream side of the sensor lever 23, the image forming part 103 that forms a toner image as a developer image on the sheet P is arranged. The image forming part 103 is provided with an image forming unit 24, an LED head 27, a transfer roller 25 and the like. The LED head 27 as an exposure device is arranged above a photoreceptor drum 26 to oppose the photoreceptor drum 26, the photoreceptor drum 26 being provided as an image carrier in the image forming unit 24. The transfer roller 25 as a transfer member is arranged below the photoreceptor drum 26 to oppose the photoreceptor drum 26 across the medium carrying route Rt1. A transfer part p1 is formed between the photoreceptor drum 26 and the transfer roller 25.

In addition to the photoreceptor drum 26 and a toner cartridge 29 as a developer housing part for housing a toner as a developer, the image forming unit 24 is provided with a charging roller as a charging device, a developing roller as a developer carrier, a developer blade as a developer regulating member, a toner supply roller as a developer supply member, a cleaning blade as a cleaning member, and the like (none of these are illustrated in the drawings).

In the image forming unit 24, a surface of the photoreceptor drum 26 that is uniformly charged by the charging roller is exposed by the LED head 27 and an electrostatic latent image is formed as a latent image. Further, a toner supplied from the toner cartridge 29 is supplied to the developing roller by the toner supply roller, and the toner on the developing roller is caused to form a thin layer by the developer blade. Next, the toner on the developing roller is attached to the electrostatic latent image on the photoreceptor drum 26, and the electrostatic latent image is developed and a toner image is formed on the photoreceptor drum 26. The toner image formed in this way is transferred by the transfer roller 25 to the sheet P.

Further, in the medium carrying route Rt1, on a downstream side of the image forming part 103, a fixing unit 28 as a fixing device is arranged. The fixing unit 28 is provided with a heating roller 28*a* as a first fixing roller inside which a heating body (not illustrated in the drawings) such as a halogen lamp is provided, and a pressing roller 28*b* as a second fixing roller that is arranged to oppose the heating roller 28*a*. The toner image on the sheet P is heated and pressurized and is fixed onto the sheet P by the heating roller 28*a* and the pressing roller 28*b*, and an image is formed.

In the medium carrying route Rt1, on a downstream side of the fixing unit 28, a sensor lever 30 as a third medium detection part for detecting the front end of the sheet P is arranged. On a downstream side of the sensor lever 30, a carrying roller 31 and a pinch roller 32 are arranged as a fourth carrying member carrying the sheet P. On a downstream side of the carrying roller 31 and the pinch roller 32, a switching guide 33 as a switching member is arranged that switches a carrying route of the sheet P and selectively connects the medium carrying route Rt1 to one of a medium discharge route Rt2, which is for discharging the sheet P out of the apparatus body, and a medium reversing route Rt3, which is for reversing the sheet P. The sensor lever 30 detects the front end of the sheet P by being brought down along with passing of the sheet P, and a discharge signal indicating that the sheet P is discharged from the medium carrying route Rt1 is sent to the controller from a sensor (not illustrated in the drawings) that is arranged as a detection output part adjacent to the sensor lever 30.

The switching guide 33 is switched by driving a solenoid (not illustrated in the drawings) as a driving part for switching, and adopts a first and a second positions e, f. When the switching guide 33 is placed at the first position e, the medium carrying route Rt1 and the medium discharge route Rt2 are connected. When the switching guide 33 is placed at the second position f, the medium carrying route Rt1 and the medium reversing route Rt3 are connected.

In the medium discharge route Rt2, on a downstream side of the switching guide 33, a carrying roller 34 and a pinch roller 35 are arranged as a fifth carrying member carrying the sheet P. On a downstream side of the carrying roller 34 and the pinch roller 35, a discharge roller 36 and a pinch roller 37 are arranged as a discharge member discharging the sheet P.

Further, in the medium reversing route Rt3, on a downstream side of the switching guide 33, a reversing roller 42 and a pinch roller 43 are arranged as a first reversing member for reversing the sheet P. On a downstream side of the reversing roller 42 and the pinch roller 43, a reversing roller 44 and a pinch roller 45 are arranged as a second reversing member for reversing the sheet P. A medium reversing part AR1 for reversing the sheet P is configured by the medium reversing route Rt3, the reversing rollers 42, 44 and the pinch rollers 43, 45.

At a lower end of the medium reversing route Rt3, a reversing guide 41 as a reversed medium guide member is arranged. The medium reversing route Rt3 is selectively connected to a reversed medium carrying route Rt4 by the reversing guide 41, and the reversed sheet P is supplied to the reversed medium carrying route Rt4.

The reversing guide 41 adopts a first and a second positions g, h, is biased by a predetermined biasing force by a spring (not illustrated in the drawings) as a bias member, and is usually placed at the first position g. When the reversing guide 41 is placed at the first position g, the medium reversing route Rt3 and the medium carrying route Rt1 are connected. When the reversing guide 41 is placed at the second position h against the biasing force of the spring, the medium reversing route Rt3 and the reversed medium carrying route Rt4 are connected. The position g is illustrated in FIG. 7. The position h is illustrated in FIG. 8.

In the reversed medium carrying route Rt4, on a downstream side of the reversing guide 41, a sensor lever 52 as a fourth medium detection part is arranged for detecting the sheet P that is reversed and supplied from the medium reversing route Rt3 to the reversed medium carrying route Rt4. On a downstream side of the sensor lever 52, a carrying roller 46 and a pinch roller 47 are arranged as a first reversed medium carrying member carrying the sheet P. On a downstream side of the carrying roller 46 and the pinch roller 47, a carrying roller 48 and a pinch roller 49 are arranged as a second reversed medium carrying member carrying the sheet P. On a downstream side of the carrying roller 48 and the pinch roller 49, a sensor lever 53 as a fifth medium detection part is arranged for detecting the sheet P carried by the reversed medium carrying route Rt4. On a downstream side of the sensor lever 53, a carrying roller 50 and a pinch roller 51 are arranged as a third reversed medium carrying member carrying the sheet P.

In this case, the carrying rollers 48, 50 are caused to rotate in response to rotation of a reversed medium motor (not illustrated in the drawings) as a driving part for reversed medium carrying, and the pinch rollers 49, 51 are caused to rotate in response to the rotation of the carrying rollers 48, 50. A first and a second driving rollers are configured by the carrying rollers 48, 50, and a first and a second driven rollers are configured by the pinch rollers 49, 51.

Each of the sensor levers 52, 53 detects the sheet P by being brought down along with passing of the sheet P, and a detection signal is sent from a sensor (not illustrated in the drawings) as a detection output part that is arranged adjacent to the each of the sensor levers 52, 53 to the controller.

In the reversed medium carrying route Rt4, on a front casing part Cf side, a drawer unit 60 is arranged as a medium guide unit and as an insertable and removable member that is insertable and removable with respect to the apparatus body and is movable in a horizontal direction. The drawer unit 60 is provided with a horizontal carrying plate 61 as a first guide member, a horizontal carrying frame 62 as a second guiding member that is separably and swingably arranged with respect to the horizontal carrying plate 61 at a position above the horizontal carrying plate 61, and the pinch rollers 49, 51 that rotatably supported with respect to the horizontal carrying frame 62. The horizontal carrying plate 61 is arranged below the reversed medium carrying route Rt4, that is, on a side of the carrying rollers 48, 50. The horizontal carrying frame 62 is arranged above the reversed medium carrying route Rt4, that is, on a side of the pinch rollers 49, 51. The sheet P is carried on the reversed medium carrying route Rt4 by the horizontal carrying plate 61 and the horizontal carrying frame 62.

A carrying part, that is, a reversed medium carrying part AR2, for carrying the reversed sheet P is configured by the reversed medium carrying route Rt4, the reversing guide 41, the horizontal carrying plate 61, the horizontal carrying frame 62, the sensor levers 52, 53, the carrying rollers 46, 48, 50 and the pinch rollers 47, 49, 51. On a downstream side of the carrying roller 50 and the pinch roller 51, the reversed medium carrying route Rt4 and the medium carrying route Rt1 merge with each other.

Further, a duplex printing unit as a medium carrying device is configured by the medium reversing part AR1 and the reversed medium carrying part AR2. A perpendicular part of the duplex printing unit is configured by the medium reversing part AR1, and a horizontal part of the duplex printing unit is configured by the reversed medium carrying part AR2.

Next, an operation of the printer 10 in a case where simplex printing is performed by forming an image on one side of the sheet P is described.

First, upon receiving print data and a print instruction from a host computer (not illustrated in the drawings) as a higher-level device (or host device), the printer 10 starts printing.

When simplex printing is specified in the print instruction with respect to the sheet P housed in the sheet cassette 12, the controller drives a sheet feeding motor (not illustrated in the drawings) for sheet feeding, causes the sheet feeding roller 13 to rotate, and causes the sheet P in the sheet cassette 12 to be brought out and to be separated one by one by the sheet feeding sub-roller 14 and the separation roller 15 to be supplied to the medium carrying route Rt1. The sheet P is carried by the intermediate carrying roller 16 and the pinch roller 17 and is sent to the resist roller 18 and the pressure roller 19, and the front end of the sheet P is detected by the sensor lever 22. In this case, the resist roller 18 and the pressure roller 19 are stopped by an electromagnetic clutch (not illustrated in the drawings) so that the sheet P abuts against the resist roller 18 and the pressure roller 19 due to a carrying force of the intermediate carrying roller 16 and the pinch roller 17, and are caused to rotate after a predetermined period of time has elapsed. Along with this, a skew of the sheet P is corrected, and the sheet P is carried by the intermediate carrying roller 20 and the pressure roller 21 and is sent to the transfer part p1.

Further, as described above, when the front end of the sheet P is detected by the sensor lever 23, a write signal is sent to the controller, and the controller sends an instruction for forming an image on the sheet P to the image forming part 103.

As a result, the LED head 27 is caused to emit light according to the print data to expose the photoreceptor drum 26, and an electrostatic latent image is formed on the photoreceptor drum 26. Next, a toner supplied from the toner cartridge 29 is supplied to the developing roller by the toner supply roller; the toner on the developing roller is attached to the electrostatic latent image on the photoreceptor drum 26; and the electrostatic latent image is developed and a toner image is formed.

Next, the toner image on the photoreceptor drum 26 is transferred to the sheet P by the transfer roller 25. Thereafter, the sheet P is sent to the fixing unit 28. In the fixing unit 28, the toner image on the sheet P is heated and pressurized and is fixed onto the sheet P by the heating roller 28*a* and the pressing roller 28*b*, and an image is formed.

In this case, as illustrated in FIG. 5, the switching guide 33 is placed at the first position e. Therefore, the sheet P discharged from the fixing unit 28, after being detected by the sensor lever 30, is carried by the carrying roller 31 and the pinch roller 32 and is supplied to the medium discharge route Rt2. In the medium discharge route Rt2, after being carried by the carrying roller 34 and the pinch roller 35, the sheet P is discharged out of the apparatus body by the discharge roller 36 and the pinch roller 37 and is stacked on the stacker 38.

Next, an operation of the printer 10 in a case where duplex printing is performed by forming images on both sides of the sheet P is described.

First, upon receiving print data and a print instruction from the host computer, the printer 10 starts printing.

When duplex printing is specified in the print instruction with respect to the sheet P housed in the sheet cassette 12, the controller drives the sheet feeding motor, causes the sheet feeding roller 13 to rotate, and causes the sheet P in the sheet cassette 12 to be brought out and to be separated one by one by the sheet feeding sub-roller 14 and the separation roller 15 to be supplied to the medium carrying route Rt1. The sheet P is carried by the intermediate carrying roller 16 and the pinch roller 17, and is sent to the resist roller 18 and the pressure roller 19 and a skew is corrected. The sheet P is further carried by the intermediate carrying roller 20 and the pressure roller 21 and is sent to the transfer part p1.

Further, when the front end of the sheet P is detected by the sensor lever 23, a write signal is sent to the controller, and the controller sends an instruction for forming an image on one side (front surface) of the sheet P to the image forming part 103.

As a result, the LED head 27 is caused to emit light according to the print data to expose the photoreceptor drum 26, and an electrostatic latent image is formed on the photoreceptor drum 26. A toner on developing roller is attached to the electrostatic latent image on the photoreceptor drum 26 and a toner image is formed.

Next, the toner image on the photoreceptor drum 26 is transferred to the sheet P by the transfer roller 25. Thereafter, the sheet P is sent to the fixing unit 28. In the fixing unit 28, the toner image on the sheet P is fixed onto the sheet P. In this way, the image is formed on the one side of the sheet P.

In this case, when the sheet P discharged from the fixing unit 28 is detected by the sensor lever 30, the solenoid is driven and, as illustrated in FIG. 6, the switching guide 33 is placed at the second position f. Further, the reversing guide 41 is biased by the biasing force of the spring and is placed at the second position h.

Next, when the front end of the sheet P carried by the carrying roller 31 and the pinch roller 32 abuts against the switching guide 33, as illustrated in FIG. 7, the reversing guide 41 is placed at the first position g against the biasing force of the spring so that the sheet P is supplied to the medium reversing route Rt3 and is carried by the reversing roller 42 and the pinch roller 43 and is further carried by the reversing roller 44 and the pinch roller 45. When a rea end of the sheet P passes through the reversing guide 41, the reversing guide 41 is biased by the biasing force of the spring and is again placed at the second position h.

The reversing guide 41 is provided with a function of a sensor lever as a medium detection part and detects the rear end of the sheet P by being again placed at the second position h, and a rear end detection signal is sent to the controller from a sensor (not illustrated in the drawings) that is arranged as a detection output part adjacent to the reversing guide 41.

When the rear end detection signal is sent from the reversing guide 41, the controller causes the reversing rollers 42, 44 and the pinch rollers 43, 45 to stop and subsequently rotate in an opposite direction. As a result, after being stopped in the medium reversing route Rt3, the sheet P is reversed and is supplied to the reversed medium carrying route Rt4.

Next, as illustrated in FIG. 8, the sheet P is detected by the sensor lever 52 and, with the one side on which the toner image is formed facing upward, is carried by the carrying rollers 46, 48 and the pinch rollers 47, 49 on the reversed medium carrying route Rt4. Thereafter, the sheet P is the sensor lever 53 and is carried by the carrying roller 50 and the pinch roller 51 and is supplied to the medium carrying route Rt1.

Next, the sheet P is carried by the intermediate carrying roller 16 and the pinch roller 17 on the medium carrying route Rt1 in a state in which the one side of the sheet P is caused to oppose the intermediate carrying roller 16 and the other side (back surface) is caused to oppose the pinch roller 17, and is sent to the resist roller 18 and the pressure roller 19 and, after a skew of the sheet P is corrected, is carried by the intermediate carrying roller 20 and the pressure roller 21 and is sent to the transfer part p1.

Further, when the front end of the sheet P is detected by the sensor lever 23, a write signal is sent to the controller, and the controller sends an instruction for forming an image on the other side of the sheet P to the image forming part 103.

As a result, the LED head 27 is caused to emit light according to the print data to expose the photoreceptor drum 26, and an electrostatic latent image is formed on the photoreceptor drum 26. A toner on developing roller is attached to the electrostatic latent image on the photoreceptor drum 26 and a toner image is formed.

Next, the toner image on the photoreceptor drum 26 is transferred to the sheet P by the transfer roller 25. Thereafter, the sheet P is sent to the fixing unit 28. In the fixing unit 28, the toner image on the sheet P is fixed onto the sheet P. In this way, the image is formed on the other side of the sheet P.

Next, when the sheet P discharged from the fixing unit 28 is again detected by the sensor lever 30, as illustrated in FIG. 5, the solenoid is driven and the switching guide 33 is placed at the first position e. Therefore, the sheet P, in a state of having images formed on both sides, is carried by the carrying roller 31 and the pinch roller 32 and is supplied to the medium discharge route Rt2. In the medium discharge route Rt2, after being carried by the carrying roller 34 and the pinch roller 35, the sheet P is discharged out of the apparatus body by the discharge roller 36 and the pinch roller 37 and is stacked on the stacker 38.

Next, a detection method of sheet jam when jamming of the sheet P, that is, sheet jam, occurs in the duplex printing unit is described.

When a detection signal is not sent to the controller from the sensor arranged adjacent to the sensor lever 52 after the reversing rollers 42, 44 and the pinch rollers 43, 45 are caused to stop and subsequently rotate in an opposite direction, or when the detection signal is continuously sent to the controller from the sensor, the controller judges that sheet jam has occurred in the medium reversing part AR1 and displays a message indicating the sheet jam has occurred in the medium reversing part AR1 in the operation panel 67 (FIG. 2) to inform an operator.

Further, when a detection signal is not sent to the controller from the sensor arranged adjacent to the sensor lever 53 after the reversing rollers 42, 44 and the pinch rollers 43, 45 are caused to stop and subsequently rotate in an opposite direction and a detection signal has been sent to the controller from the sensor arranged adjacent to the sensor lever 52, or when the detection signal is continuously sent to the controller from the sensor, the controller judges that sheet jam has occurred in the reversed medium carrying part AR2 and displays a message indicating the sheet jam has occurred in the reversed medium carrying part AR2 in the operation panel 67 to inform the operator.

Next, a method for taking out a sheet from the medium reversing part AR1 when sheet jam occurs in the medium reversing part AR1 is described.

Figure 9:
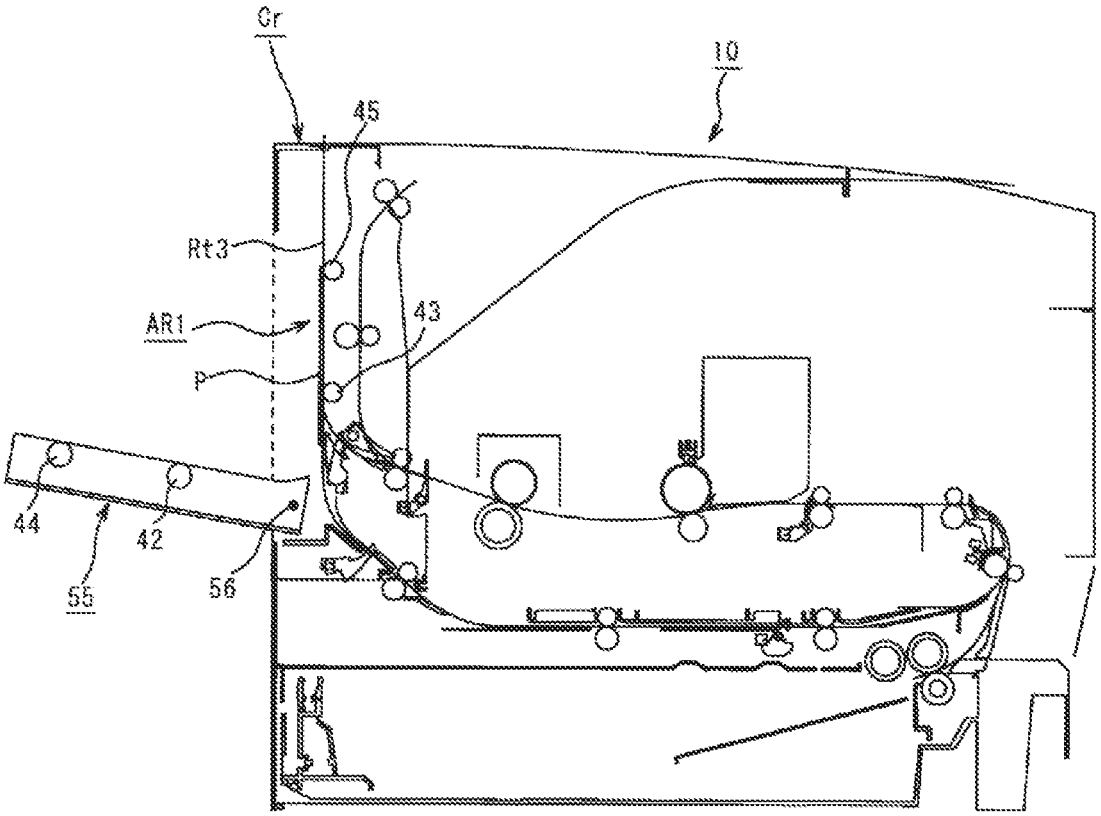
FIG. 9 illustrates a schematic diagram of the printer for describing a method for taking out a sheet from a medium reversing part in the first embodiment of the present invention.
Figure 10:
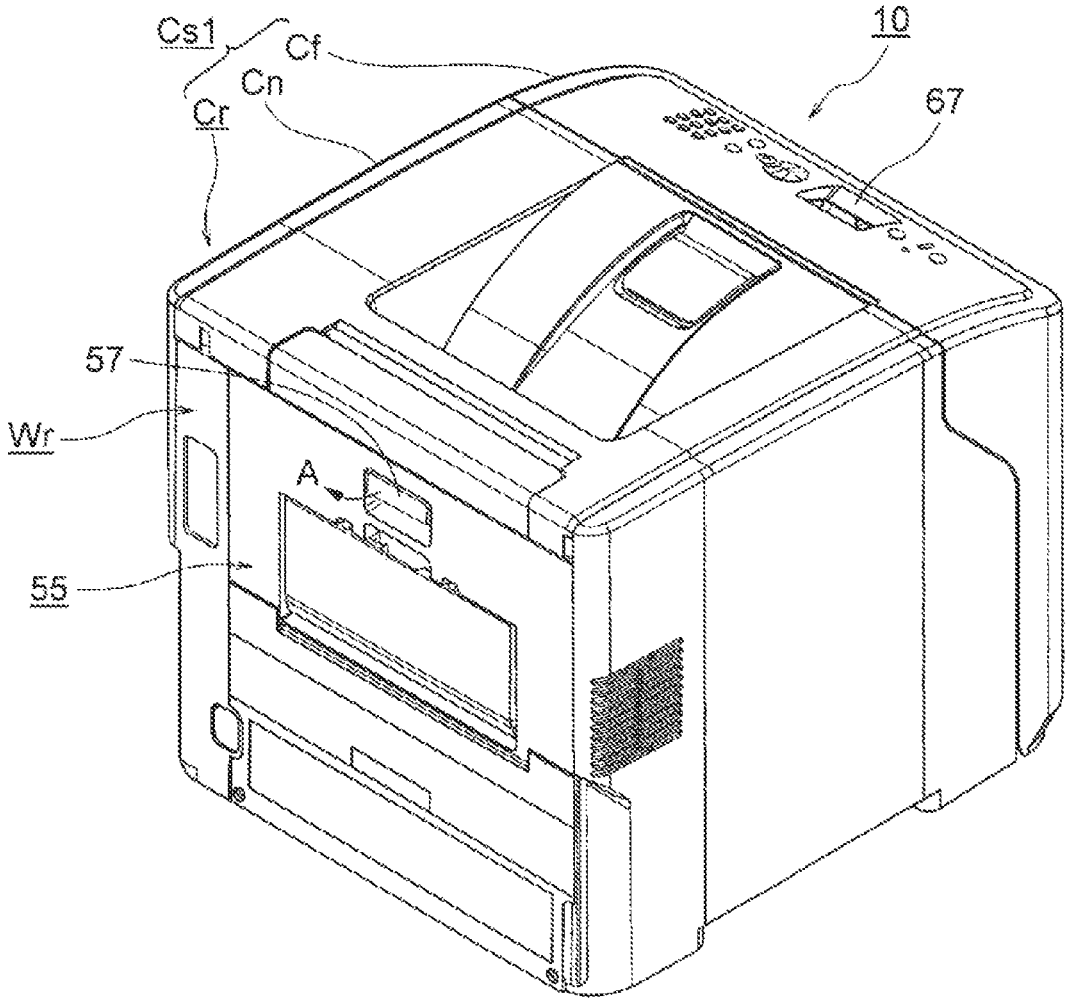
FIG. 10 illustrates a first perspective view of the printer for describing the method for taking out a sheet from the medium reversing part in the first embodiment of the present invention.
Figure 11:
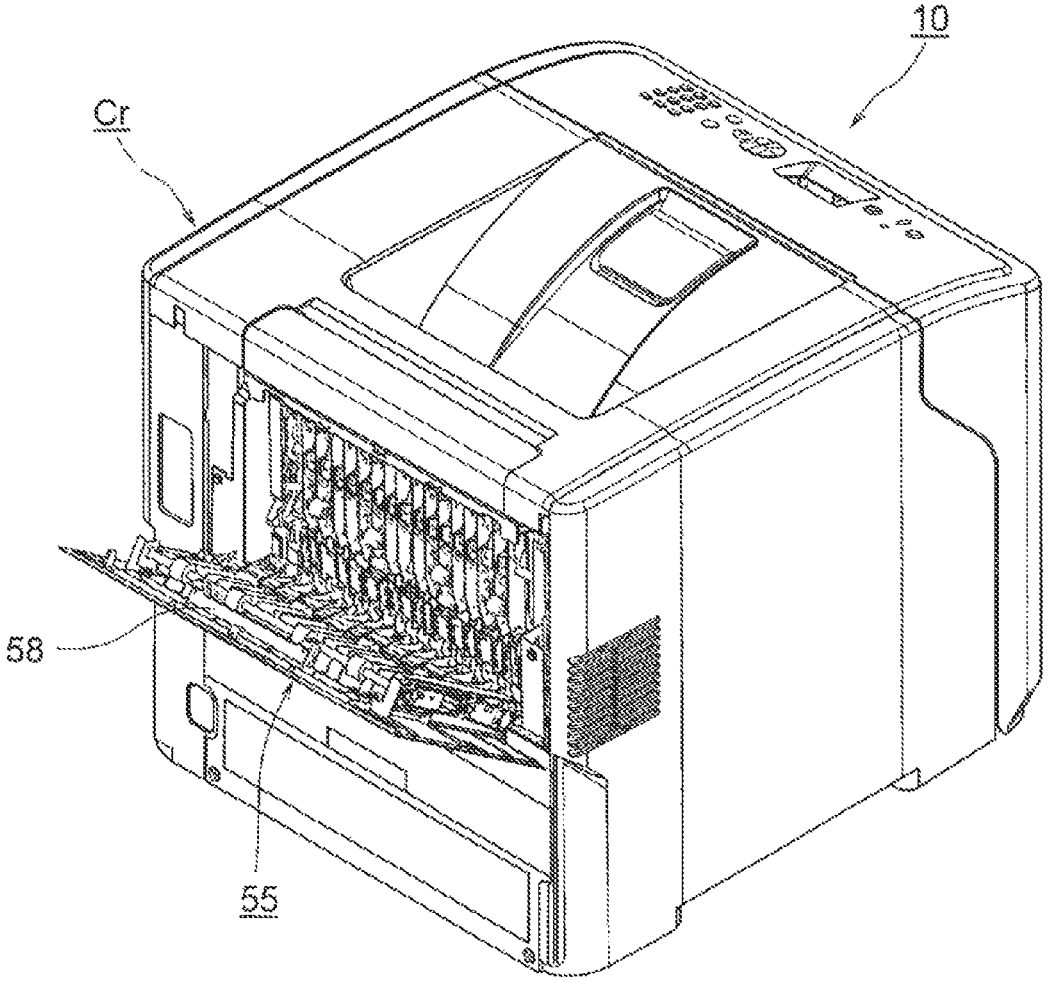
FIG. 11 illustrates a second perspective view of the printer for describing the method for taking out a sheet from the medium reversing part in the first embodiment of the present invention.

FIG. 9 illustrates a schematic diagram of a printer for describing a method for taking out a sheet from a medium reversing part in the first embodiment of the present invention. FIG. 10 illustrates a first perspective view of the printer for describing the method for taking out a sheet from the medium reversing part in the first embodiment of the present invention. FIG. 11 illustrates a second perspective view of the printer for describing the method for taking out a sheet from the medium reversing part in the first embodiment of the present invention.

In the drawings, a reference numeral symbol Cs1 denotes a casing of a printer 10; a reference numeral symbol Cn denotes a central casing part; a reference numeral symbol Cf denotes a front casing part; and a reference numeral symbol Cr denotes a rear casing part. A rear cover 55 as rear opening and closing member is arranged swingable about a pivot shaft 56 and openable and closable at a position opposing the medium reversing part AR1 on a back wall Wr of the rear casing part Cr.

An opening and closing knob 57 as an operation part for opening and closing the rear cover 55 is arranged as a predetermined place of the rear cover 55, in the present embodiment, in a vicinity of an upper edge of the rear cover 55.

When sheet jam occurs in the medium reversing part AR1, an message indicating that sheet jam has occurred in the medium reversing part AR1 is displayed in the operation panel 67 to inform the operator. As a result, when the operator pulls the opening and closing knob 57 in a direction of an arrow A, which is shown in FIG. 10, engagement between a lock member 58 arranged at the upper edge of the rear cover 55 rear and a body of the casing part Cr is released and, as illustrated in FIG. 11, the rear cover 55 is opened.

In this case, the reversing rollers 42, 44 are arranged on the rear cover 55, and the pinch rollers 43, 45 are arranged on the apparatus body so that, along with the opening of the rear cover 55, the reversing rollers 42, 44 and the pinch rollers 43, 45 are separated. Therefore, the sheet P can be easily taken out. Therefore, the sheet jam can be cleared.

Next, a method for taking out a sheet from the reversed medium carrying part AR2 when sheet jam occurs in the reversed medium carrying part AR2 is described.

Figure 1:
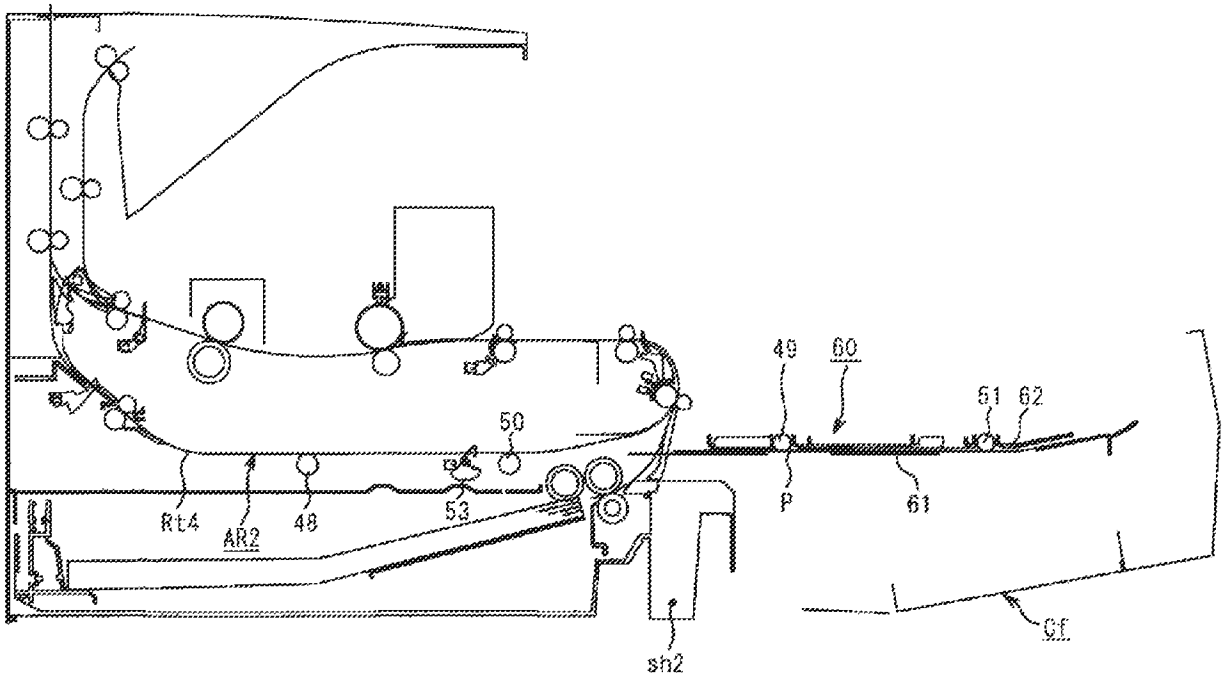
FIG. 1 illustrates a first schematic diagram of a printer for describing a method for taking out a sheet from a reversed medium carrying part in a first embodiment of the present invention.
Figure 12:
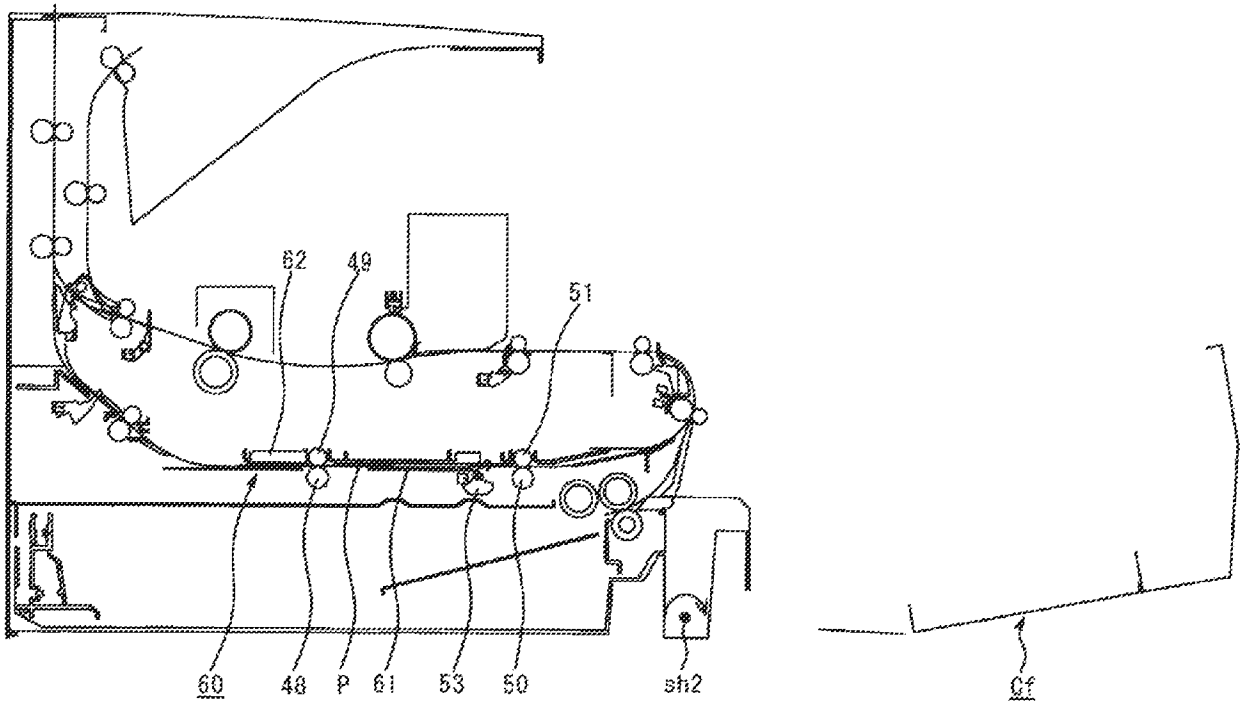
FIG. 12 illustrates a second schematic diagram of the printer for describing the method for taking out a sheet from the reversed medium carrying part in the first embodiment of the present invention.
Figure 13:
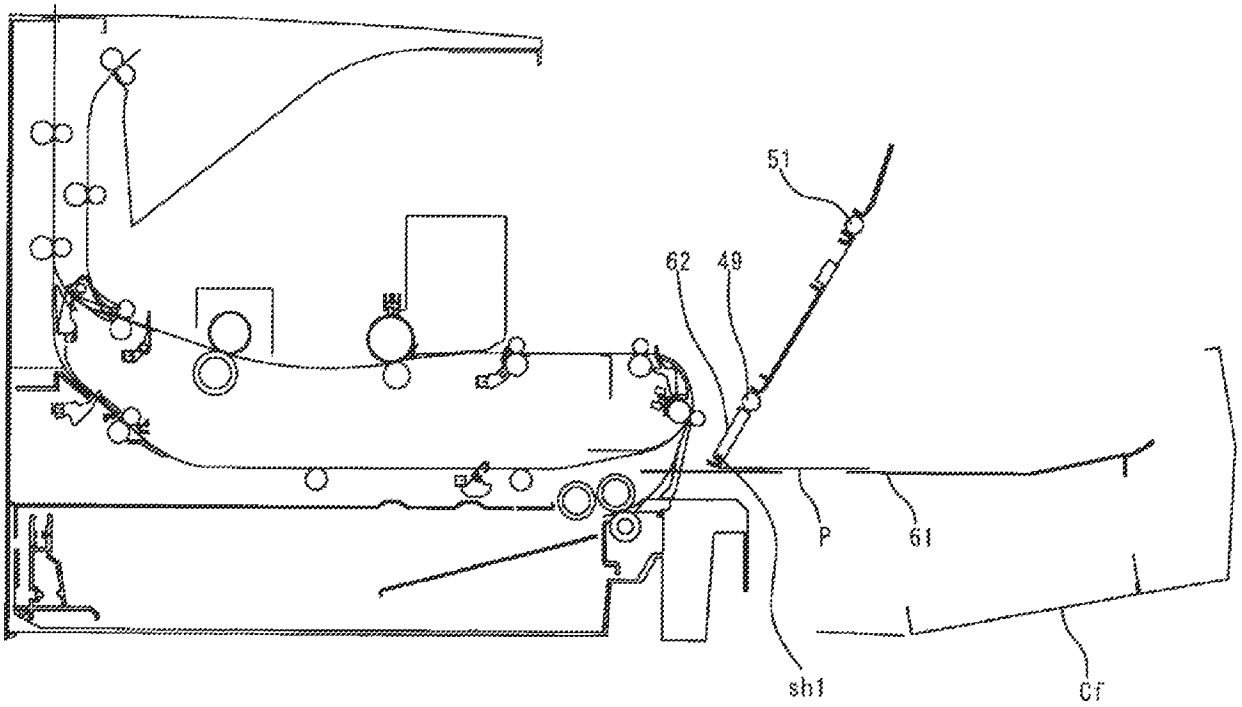
FIG. 13 illustrates a second schematic diagram of the printer for describing the method for taking out a sheet from the reversed medium carrying part in the first embodiment of the present invention.
Figure 14:
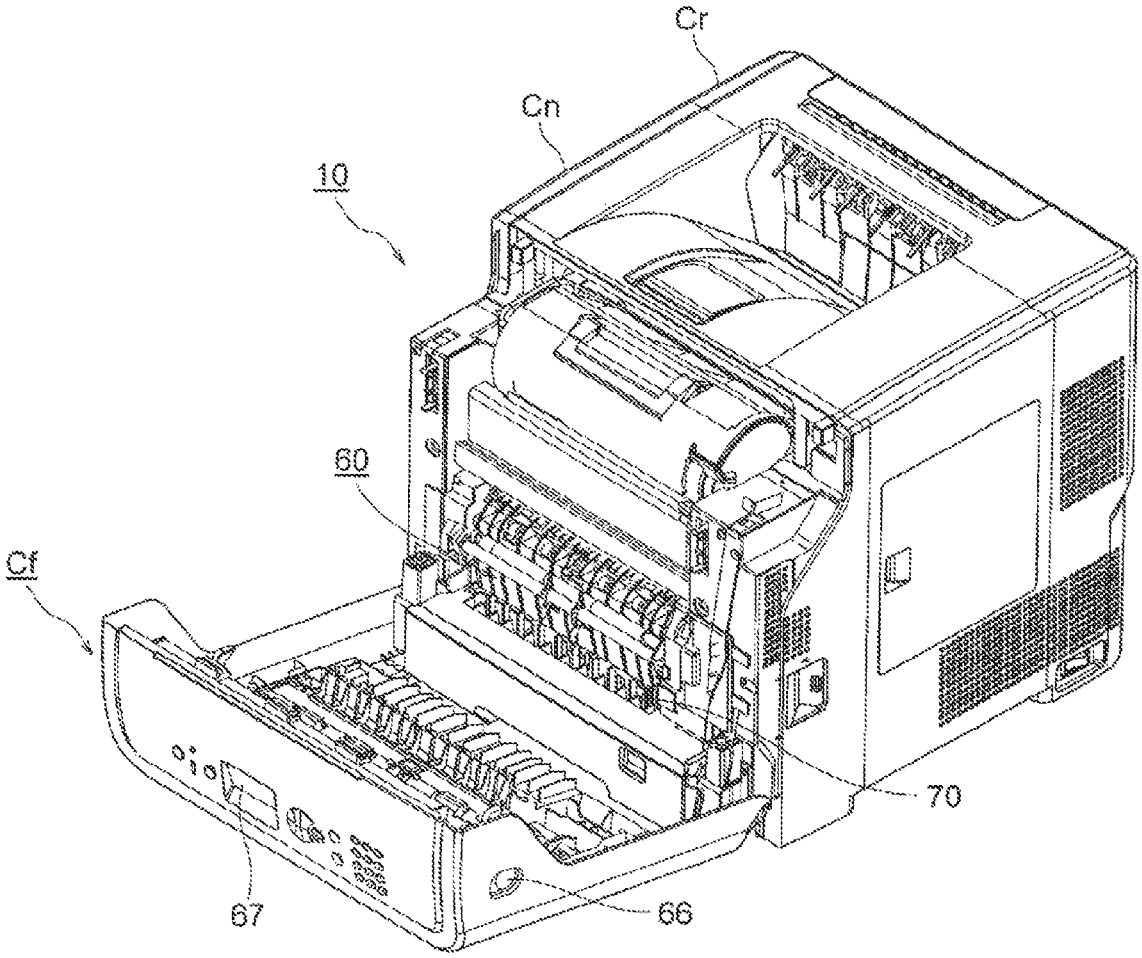
FIG. 14 illustrates a first perspective view of the printer for describing the method for taking out a sheet from the reversed medium carrying part in the first embodiment of the present invention.
Figure 15:
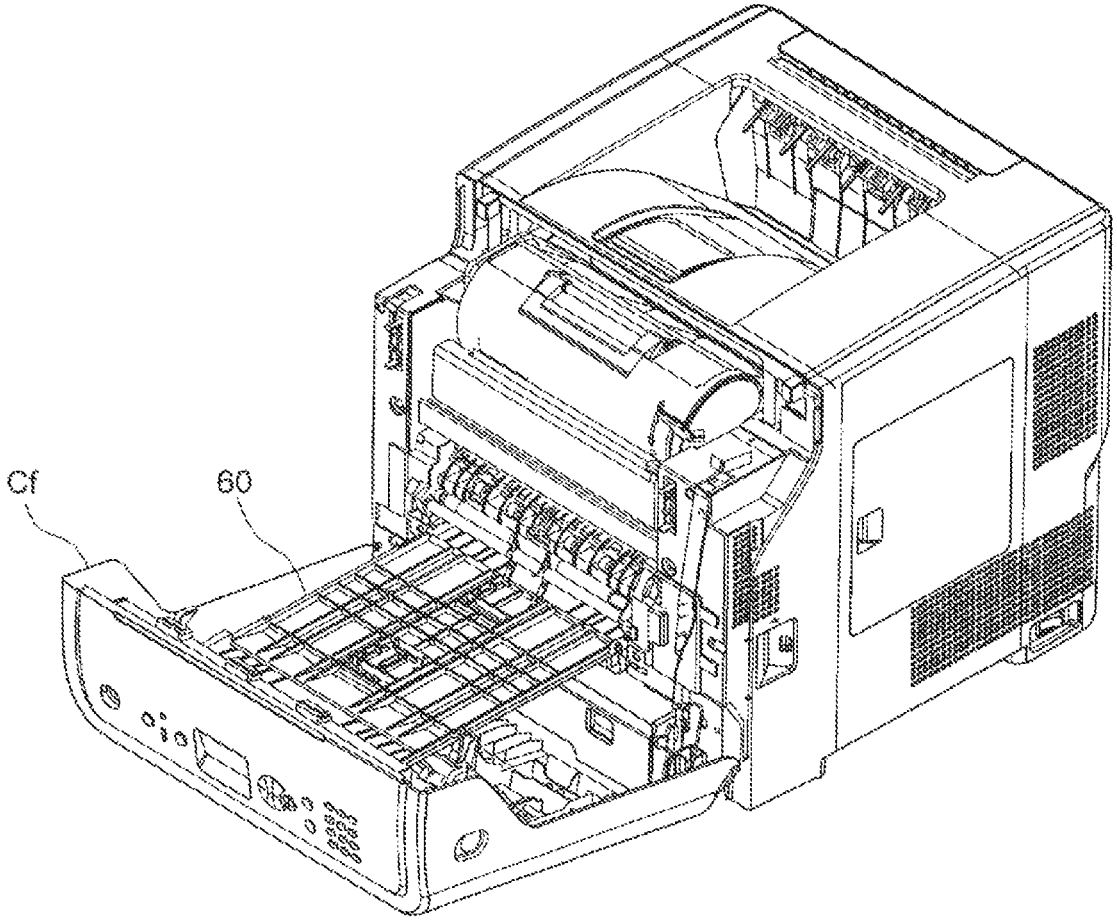
FIG. 15 illustrates a second perspective view of the printer for describing the method for taking out a sheet from the reversed medium carrying part in the first embodiment of the present invention.
Figure 16:
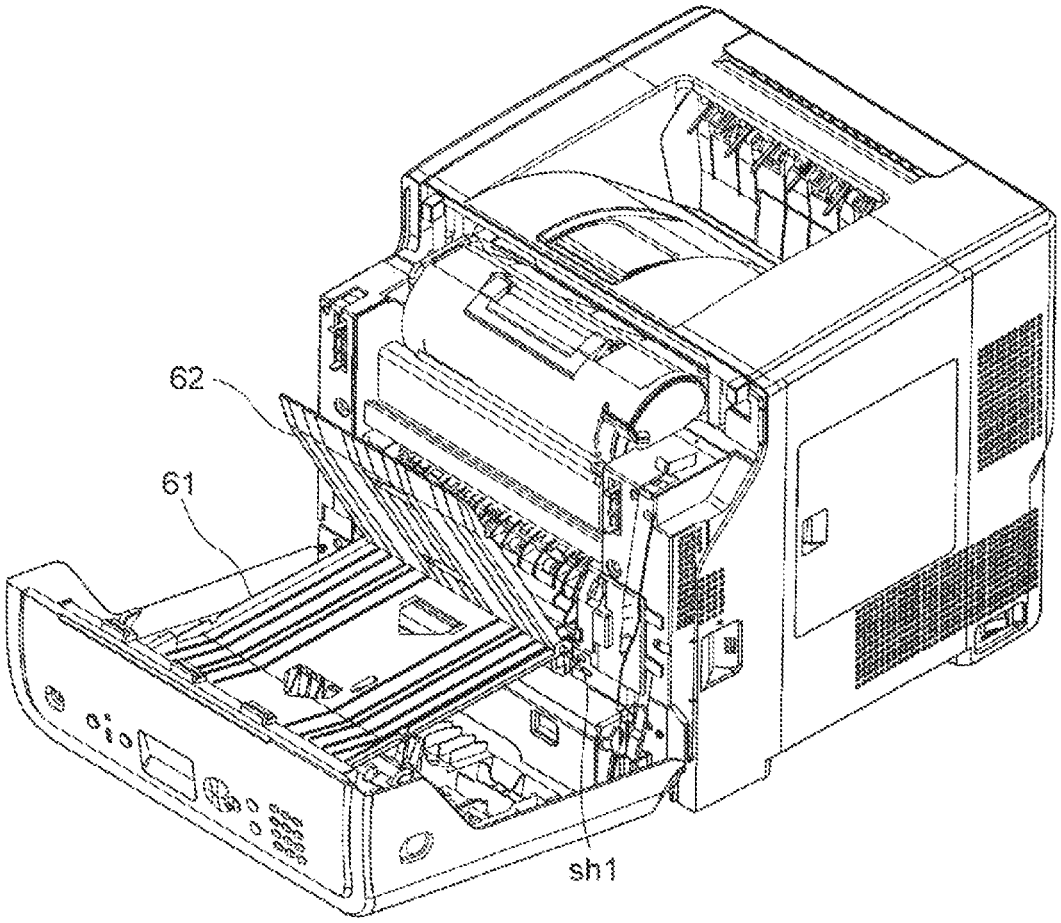
FIG. 16 illustrates a third perspective view of the printer for describing the method for taking out a sheet from the reversed medium carrying part in the first embodiment of the present invention.

FIG. 1 is a first schematic diagram of a printer for describing a method for taking out a sheet from a reversed medium carrying part in a first embodiment of the present invention. FIG. 12 is a second schematic diagram of a printer for describing a method for taking out a sheet from a reversed medium carrying part in the first embodiment of the present invention. FIG. 13 is a third schematic diagram of a printer for describing a method for taking out a sheet from a reversed medium carrying part in the first embodiment of the present invention. FIG. 14 illustrates a first perspective view of the printer for describing the method for taking out a sheet from the reversed medium carrying part in the first embodiment of the present invention. FIG. 15 illustrates a second perspective view of the printer for describing the method for taking out a sheet from the reversed medium carrying part in the first embodiment of the present invention. FIG. 16 illustrates a third perspective view of the printer for describing the method for taking out a sheet from the reversed medium carrying part in the first embodiment of the present invention.

In the drawings, a reference numeral symbol Cn denotes a central casing part; a reference numeral symbol Cf denotes a front casing part; and a reference numeral symbol Cr denotes a rear casing part. The front casing part Cf is arranged swingable about a pivot shaft sh2 arranged in the apparatus body and is provided with a lock lever 66 for releasing a lock of the front casing part Cf. Further, a reference numeral symbol AR2 denotes a reversed medium carrying part; a reference numeral symbol Rt4 denotes a reversed medium carrying route; and a reference numeral symbol 60 denotes a drawer unit.

When sheet jam occurs in the reversed medium carrying part AR2, a message indicating that sheet jam has occurred in the reversed medium carrying part AR2 is displayed in the operation panel 67 to inform the operator. As a result, the operator operates the lock lever 66 arranged on the front casing part Cf and, as illustrated in FIGS. 12 and 14, opens the front casing part Cf. By pulling a handle 70 formed on a front end of the drawer unit 60, as illustrated in FIGS. 1 and 15, the drawer unit 60 can be pulled out from the apparatus body.

In this embodiment, the pinch rollers 49, 51 are arranged on the drawer unit 60. On the other hand, the carrying rollers 48, 50 and sensor lever 53 are arranged in the apparatus body. Therefore, along with pulling the drawer unit 60 out from the apparatus body, the carrying rollers 48, 50 and the pinch rollers 49, 51 can be separated. The sheet P that remains in the drawer unit 60 can be pulled out together with the drawer unit 60 from the apparatus body.

After the drawer unit 60 is pulled out as illustrated in FIGS. 13 and 16, the operator opens the horizontal carrying frame 62 by rotating the horizontal carrying frame 62 about a pivot shaft sh1 so that the sheet P can be taken out.

Next, the drawer unit 60 is described.

Figure 17:
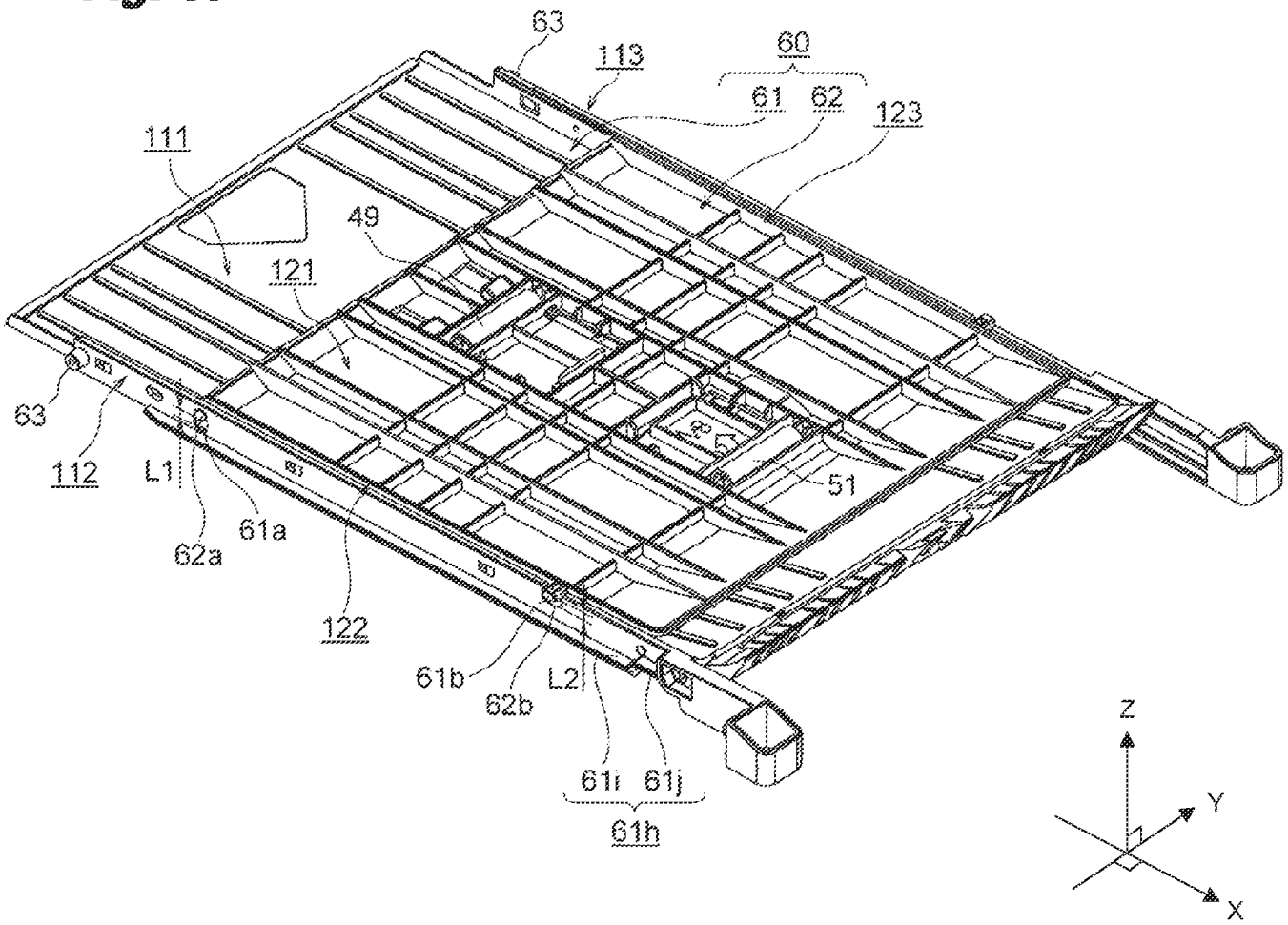
FIG. 17 illustrates a perspective view of a drawer unit 60, which is an actual structure of a medium guide unit of the invention, in the first embodiment of the present invention. In the drawing, the drawer unit 60 is configured with a horizontal carrying plate 61 and a horizontal carrying frame 62.
Figure 18:
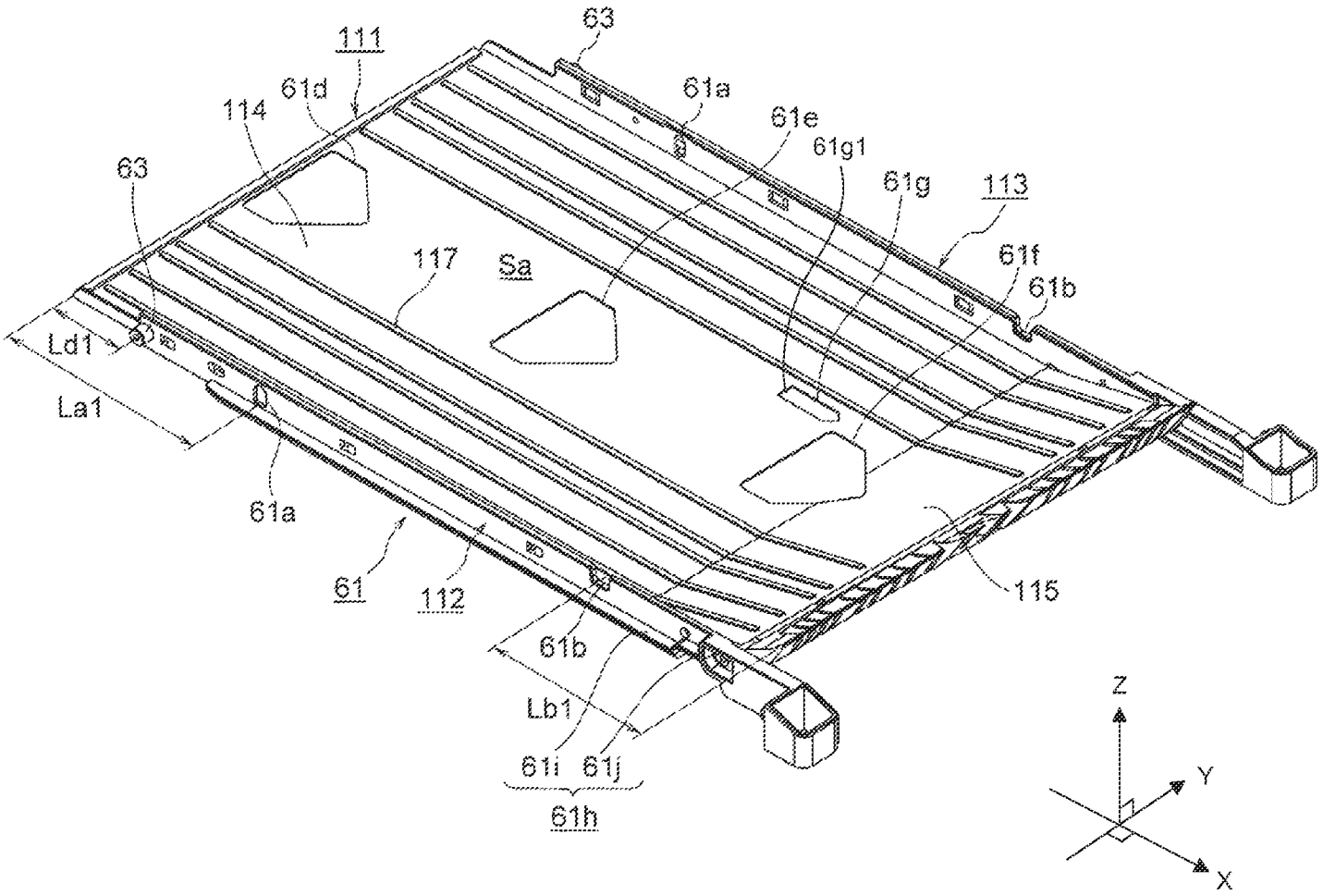
FIG. 18 illustrates a perspective view of the horizontal carrying plate 61 in the first embodiment of the present invention.
Figure 19:
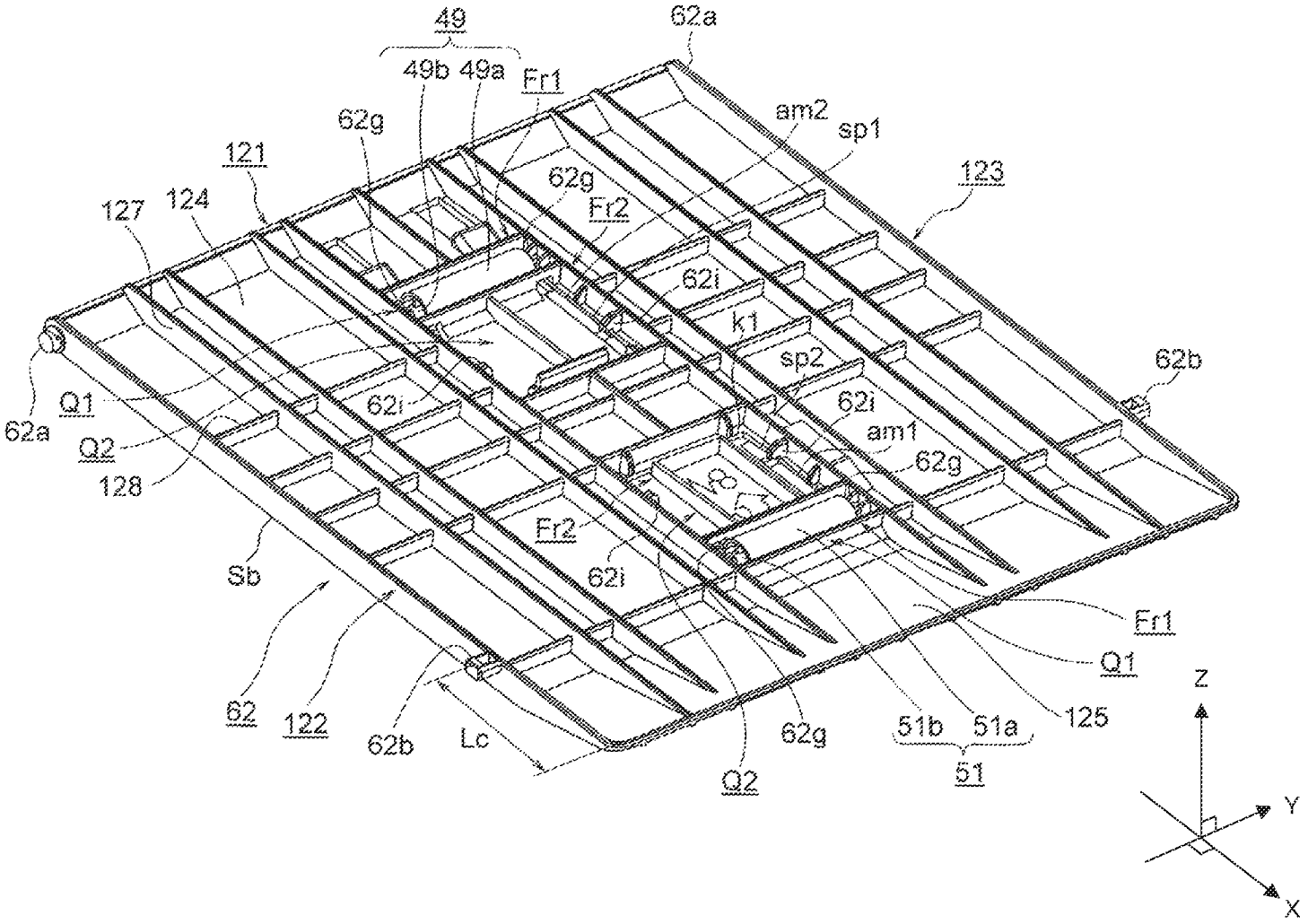
FIG. 19 illustrates a perspective view of the horizontal carrying frame 62 in the first embodiment of the present invention.
Figure 20:
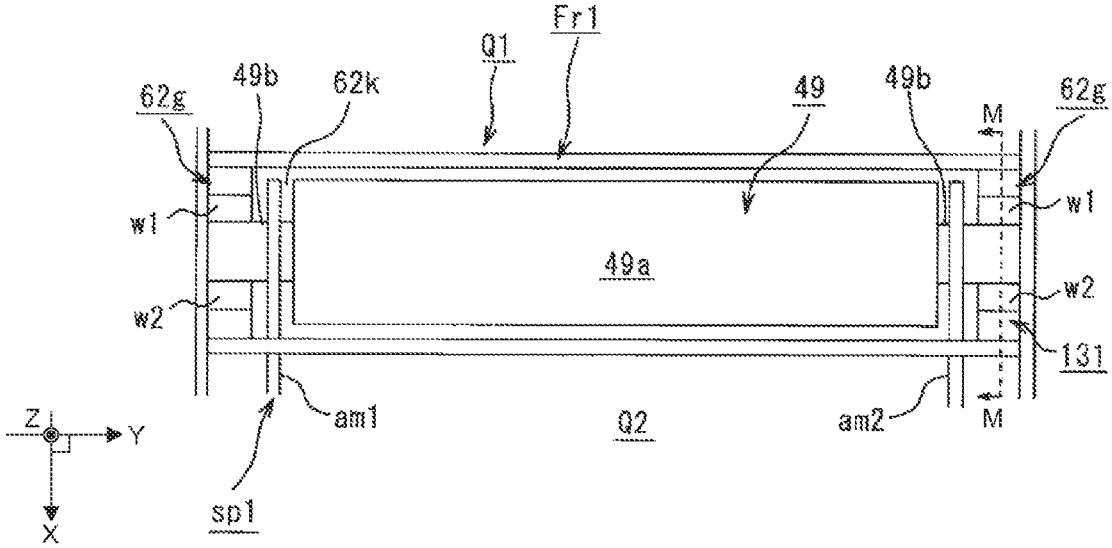
FIG. 20 illustrates a plan view illustrating an arrangement state of a pinch roller in the first embodiment of the present invention.
Figure 21:
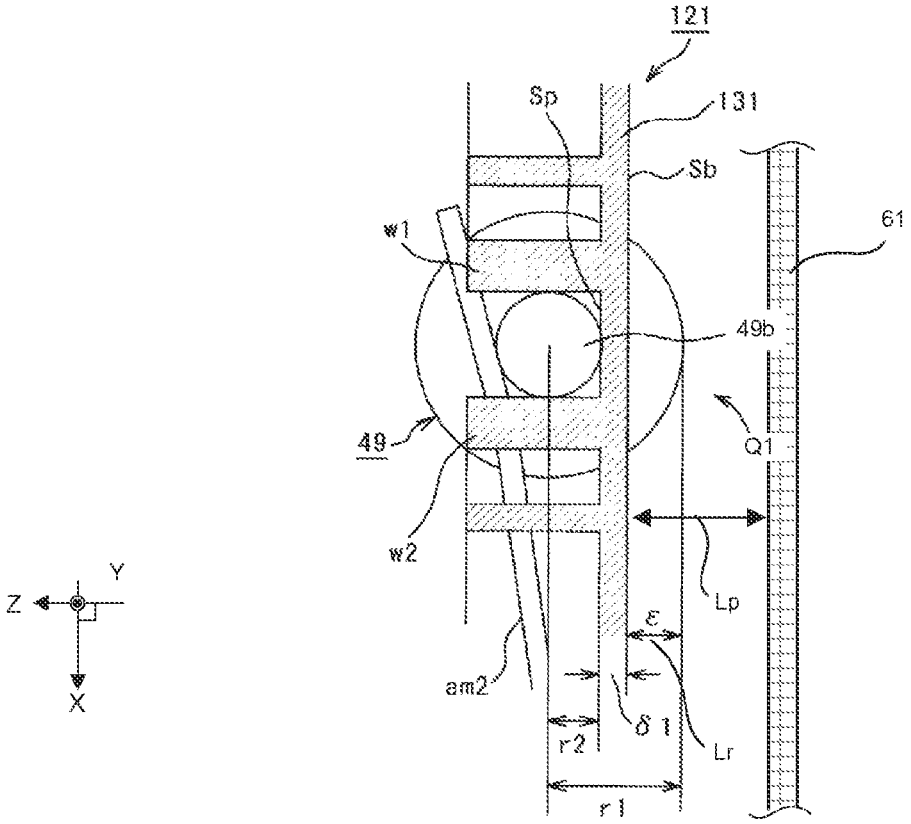
FIG. 21 illustrates a cross-sectional view along a line M-M of FIG. 20.

FIG. 17 illustrates a perspective view of a drawer unit in the first embodiment of the present invention. FIG. 18 illustrates a perspective view of a horizontal carrying plate in the first embodiment of the present invention. FIG. 19 illustrates a perspective view of a horizontal carrying frame in the first embodiment of the present invention. FIG. 20 illustrates a plan view illustrating an arrangement state of a pinch roller in the first embodiment of the present invention. FIG. 21 illustrates a cross-sectional view along a line M-M of FIG. 20. In FIG. 17, a direction along which the sheet P is carried is shown X direction. The reversed medium carrying rout Rt4 is along the X direction. The forward direction of the sheet is defined as forward. In this specification, the downstream side of the reversed medium carrying rout Rt4 (or lower right hand in the drawing) is called a front side. The upstream side, namely the opposite side from the lower right hand, is called a rear side. The width direction of the sheep P, which is on the surface of the sheet P and perpendicular to X direction, is Y direction. The thickness direction of the sheet P, which is perpendicular to both of X and Y directions, is Z direction.

In the drawings, a reference numeral symbol 60 denotes a drawer unit; a reference numeral symbol 61 denotes a horizontal carrying plate as a first guide member; and a reference numeral symbol 62 denotes a horizontal carrying frame as a second guide member.

The horizontal carrying plate 61 has a rectangular and plate shape, and is provided with a guide part 111 that is provided with a guiding surface Sa guiding the sheet P at a position below the sheet P (FIG. 1) that passes through the drawer unit 60, and side edge parts 112, 113 that are erected and formed at both edges of the guide part 111 in a manner protruding substantially orthogonally with respect to the guiding surface Sa and form wall surfaces. The guide part 111 is an entire part shown in FIG. 18 including the guiding surface Sa. The guiding surface Sa is a surface of the guide part 111 which is shown in FIG. 18. Further, the horizontal carrying frame 62 has a rectangular and plate shape, and is provided with a guide part 121 that is provided with a guiding surface Sb guiding the sheet P at a position above the sheet P, and side edge parts 122, 123 that are erected and formed at both edges of the guide part 121 in a manner protruding substantially orthogonally with respect to the guiding surface Sb and form wall surfaces. The guiding surface Sb is arranged along the upper surface side of the medium carrying route.

The drawer unit 60 is inserted or removed in a direction substantially parallel to a direction along which the guiding surfaces Sa, Sb extend, in the present embodiment, in a direction within a range of ±20[°] of the extension direction of the guiding surfaces Sa, Sb.

In the horizontal carrying plate 61, the guide part 111 is provided with a body part 114 that is formed by extending in the horizontal direction; an inclined part 115 that is formed by extending obliquely upward from a front end of the body part 114 and is for guiding the sheet P that passes through the drawer unit 60 to the intermediate carrying roller 16 and the pinch roller 17; a plurality of ribs 117 that extend in a carrying direction of the sheet P and are formed at a predetermined distance from each other; and the like. In a flat portion where the ribs 117 are not formed, in a range from a rear end to the front end of the guide part 111, a plurality of, in the present embodiment, three openings 61*d*, 61*e*, 61*f* are formed at a predetermined interval from each other; and an opening 61*g* is formed adjacent to the opening 61*f*. The openings 61*e*, 61*f* are respectively formed at positions corresponding to the pinch rollers 49, 51 that are arranged on the horizontal carrying frame 62. In a state in which the drawer unit 60 is arranged inside the apparatus body, in the reversed medium carrying route Rt4, the carrying roller 48 and the pinch roller 49 are in contact with each other and further the carrying roller 50 and the pinch roller 51 are in contact with each other. Further, in the state in which the drawer unit 60 is arranged inside the apparatus body, the sensor lever 53 is cud to protrude via the opening 61*g* to the reversed medium carrying route Rt4.

Further, in the horizontal carrying frame 62, the guide part 121 is provided with a body part 124 that is formed by extending in the horizontal direction; an inclined part 125 that is formed by extending obliquely upward from a front end of the body part 124 and is for guiding, together with the inclined part 115, the sheet P that passes through the drawer unit 60 to the intermediate carrying roller 16 and the pinch roller 17; a plurality of ribs 127 that extend in the carrying direction of the sheet P and are formed at a predetermined distance from each other; a plurality of ribs 128 that extend in a direction perpendicular to the carrying direction of the sheet P, that is, in a width direction of the guide part 121, and are formed at a predetermined distance from each other; and the like.

Further, at a central part in the width direction (or Y direction) of the guide part 121, the pinch rollers 49, 51 are respectively rotatably supported in a state of being biased toward a horizontal carrying plate 61 side by rod-shaped springs sp1, sp2 as bias members.

Therefore, at predetermined places of the guide part 121, roller holding parts Q1 for respectively holding the pinch rollers 49, 51 are formed, and bias member holding parts Q2 for respectively holding the springs sp1, sp2 are formed at positions adjacent to the roller holding parts Q1.

Further, in order to allow the sheet P to pass through between the horizontal carrying plate 61 and the horizontal carrying frame 62, in the state in which the drawer unit 60 is arranged inside the apparatus body, a predetermined gap d is formed in Z direction between the horizontal carrying plate 61 and the horizontal carrying frame 62. The gap is illustrated with reference "d" in FIG. 22. Further, when the drawer unit 60 is pulled out from the apparatus body or is inserted into the apparatus body, to prevent the drawer unit 60 from interfering with the carrying rollers 48, 50 (FIG. 1), the sensor lever 53 and the like, the horizontal carrying plate 61 is moved toward the horizontal carrying frame 62 and is brought into contact with the horizontal carrying frame 62 via the sheet P, and the gap disappears (becomes 0).

Further, in the drawer unit 60 that is pulled out from the apparatus body, in order to allow the sheet P jammed between the horizontal carrying plate 61 and the horizontal carrying frame 62 to be taken out, the horizontal carrying frame 62 is swingably supported with respect to the horizontal carrying plate 61.

Therefore, in the horizontal carrying plate 61, at predetermined positions on the side edge parts 112, 113, in the present embodiment, at positions a predetermined distance La1 forward from the rear end of the guide part 111, elongated holes 61*a* as first supporting parts having a predetermined shape, an O-shaped shape in the present embodiment, are formed. Also at positions a predetermined distance Lb1 rearward from the front end of the guide part 111, elongated holes 61*b* as second supporting parts having a predetermined shape, a U-shaped shape with an opening upper end in the present embodiment, are formed by long grooves on the side edge parts 112, 113.

Further, in the horizontal carrying frame 62, at predetermined positions on the side edge parts 122, 123, in the present embodiment, at positions on the rear end of the guide part 121, post parts 62*a* as first supported parts having a predetermined shape, in the present embodiment, a column-shaped shape, are formed in a manner protruding toward outside of both edges of the guide part 121; and at positions a predetermined distance Lc rearward from the front end of the guide part 121, post parts 62*b* as second supported parts having a predetermined shape, in the present embodiment, a shape of a rectangular column, are formed in a manner protruding toward outside (or + and −Y directions) of both edges of the guide part 121.

Therefore, by fitting the post parts 62*a* into the elongated holes 61*a*, in the drawer unit 60 pulled out from the apparatus body, by rotating the horizontal carrying frame 62 using the post parts 62*a* as the pivot shaft sh1 (FIG. 16), the sheet P jammed between the horizontal carrying plate 61 and the horizontal carrying frame 62 can be taken out.

Figure 33B:
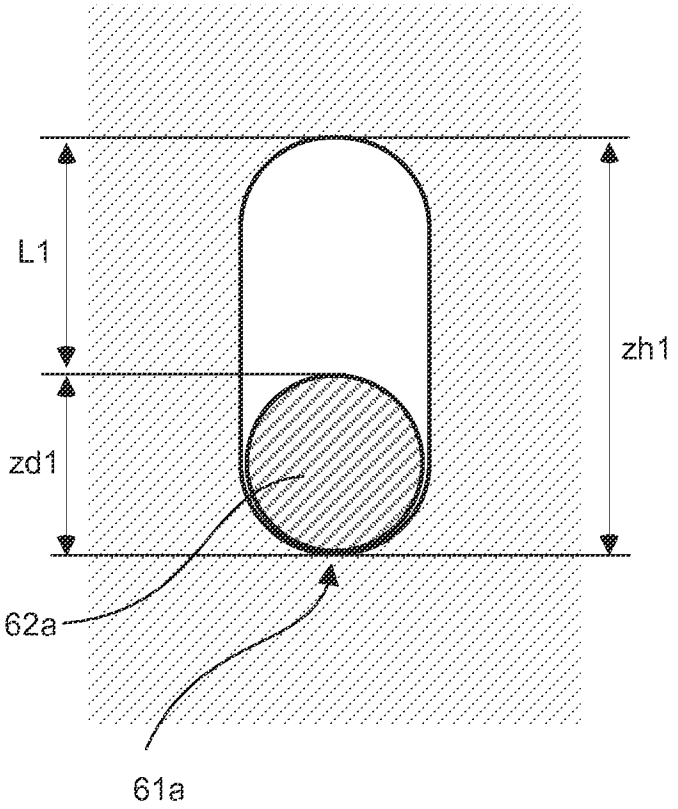
FIGS. 33A and 33B illustrate relationship between the elongated holes 61*a* and the post parts 62*a* in the first embodiment.
Figure 33A:
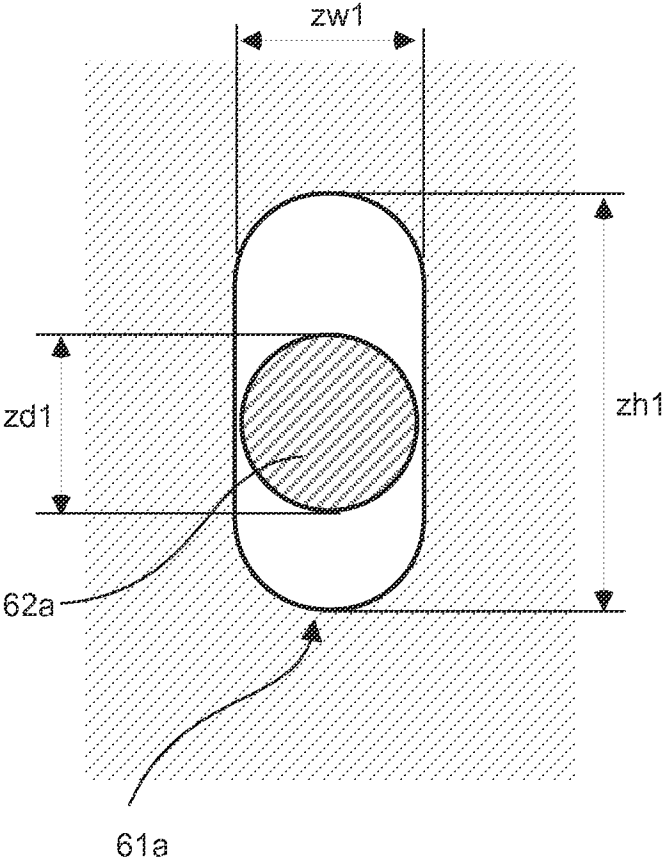
Figure 33D:
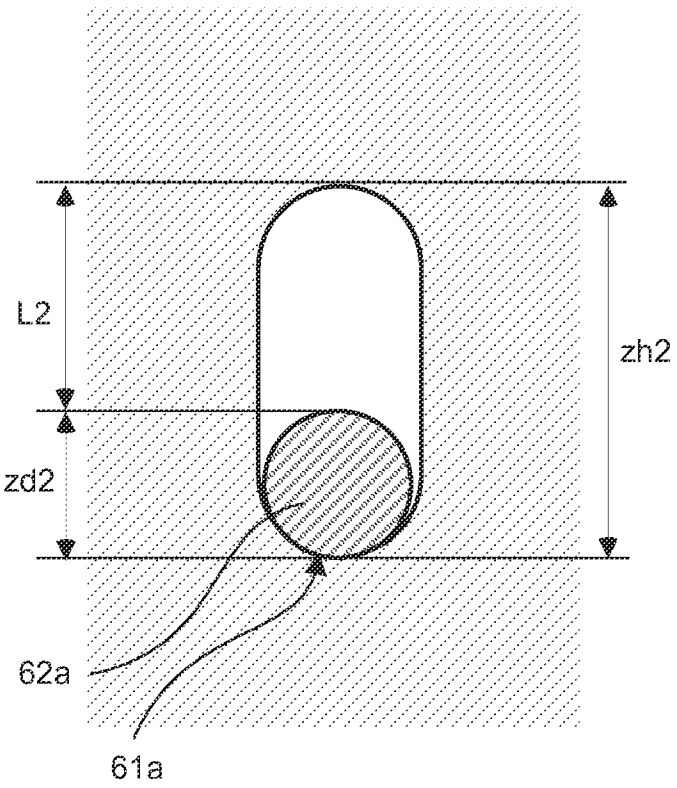
FIGS. 33C and 33D illustrate a modified version of the elongated holes 61*a* and the post parts 62*a*.
Figure 33C:
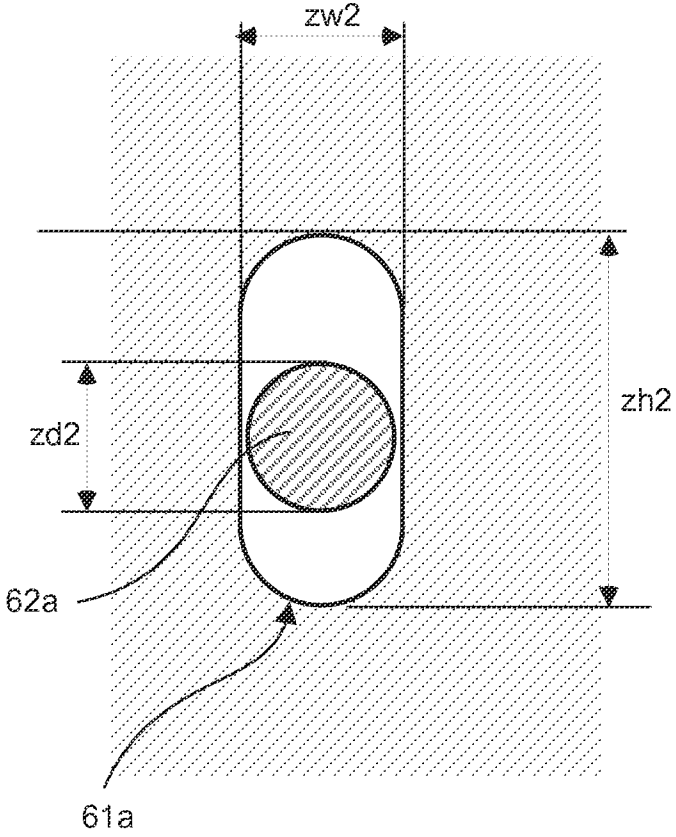

The relationships between the elongated holes 61*a* and the post parts 62 are illustrated in FIGS. 33A to 33D. In the embodiment, the elongated holes 61*a* and the post parts 62 are symmetrically arranged the right and left sides with respect to the drawer unit 60. As shown in FIGS. 33A and 33B, when a reference numeral symbol zw1 denotes a dimension of the elongated holes 61*a* in the horizontal direction (the carrying direction of the sheet P), that is, a width, a reference numeral symbol zh1 denotes a dimension of the elongated holes 61*a* in a perpendicular direction, that is, a height, and a reference numeral symbol zd1 denotes a diameter of the post parts 62*a*, the width zw1 is slightly greater than the diameter zd1, and the height zh1 is greater than the diameter zd1 by a predetermined dimension L1. Further, as shown in FIGS. 33C and 33D, when a reference numeral symbol zw2 denotes a width of the elongated holes 61*b*, a reference numeral symbol zh2 denotes a height o the elongated holes 61*b*, and a reference numeral symbol zd2 denotes a diameter of the post parts 62*b*, the width zw2 is slightly greater than the diameter zd2, and the height zh2 is greater than the diameter sd2 by a predetermined dimension L2. In the present embodiment, the dimensions L1, L2 obey L1=L2.

Therefore, by fitting (loosely fitting) the post parts 62*a* into the elongated holes 61*a* in a manner movable in a up-down direction, and fitting the post parts 62*b* into the elongated holes 61*b* in a manner movable in the up-down direction (or Z direction), the horizontal carrying plate 61 and the horizontal carrying frame 62 can be allowed to relatively move in the up-down direction. That is, in the state in which the drawer unit 60 is arranged inside the apparatus body, the horizontal carrying plate 61 is placed at a lower position in the vertical direction as a first position so as to allow the sheet P to pass through, and a predetermined gap d is formed between the horizontal carrying plate 61 and the horizontal carrying frame 62.

Further, when a reference numeral symbol Lr denotes a protrusion amount, that is, an amount that the carrying rollers 48, 50 protrude from the openings 61*e*, 61*f* to the horizontal carrying frame 62 side in the state in which the drawer unit 60 is arranged inside the apparatus body, and a reference numeral symbol Lp denotes a movement amount, that is, an amount that the horizontal carrying plate 61 moves from the lower position in the vertical direction to the upper position in the vertical direction when the drawer unit 60 is pulled out from the apparatus body, the movement amount Lp is larger than the protrusion amount Lr.

Therefore, when the drawer unit 60 is pulled out from the apparatus body or is inserted into the apparatus body, the drawer unit 60 does not interfere with the carrying rollers 48, 50, the sensor lever 53 and the like.

In the present embodiment, when the gap is denoted by a reference numeral symbol d, the gap d is equal to the dimensions L1, L2.

Next, the roller holding parts Q1 and the bias member holding parts Q2 are described. The roller holding part Q1 and the bias member holding part Q2 of the pinch roller 49 respectively have the same structures as those of the roller holding part Q1 and the bias member holding part Q2 of the pinch roller 51. Therefore, in FIGS. 20 and 21, only the roller holding part Q1 and the bias member holding part Q2 of the pinch roller 49 are illustrated.

The pinch roller 49, 51 is provided with a roller part 49*a*, 51*a* and a roller shaft part 49*b*, 51*b* that is formed by protruding from both ends of the roller part 49*a*, 51*a*.

In the roller holding part Q1, a rectangular frame part Fr1 is formed by predetermined ribs 128. In the frame part Fr1, the pinch roller 49, 51 is housed. The roller shaft part 49*b*, 51*b* is supported by a roller regulating part 62*g* as a shaft holding part that is formed on both ends in the frame part Fr1. The roller regulating part 62*g* is formed by a bottom wall 131 of the guide part 121 and two wall bodies w1, w2 that protrude from the bottom wall 131 in a manner sandwiching the roller shaft part 49*b*, 51*b* and are substantially orthogonal to the guiding surface Sb. The roller shaft part 49*b*, 51*b* is arranged between the wall bodies w1, w2 and is slidable with respect to the wall bodies w1, w2.

Further, in the bias member holding part Q2, a rectangular frame part Fr2 is formed adjacent to the frame part Fr1 by predetermined ribs 128. The spring sp1, sp2 is house in the frame part Fr2. The spring sp1, sp2 has connecting parts k1 that are in a U-shape and connect the arms am1 and am2, and, in a state in which vicinities of front ends of the arms am1, am2 and each of the arms am1 and the arms am2. The spring sp1, sp2 are in contact with the roller shaft part 49*b*, 51*b* and the connecting parts k1 are in contact with the bottom wall 131, are attached to the bias member holding part Q2 by having vicinities of central parts of the arms am1, am2 engaged with hook-shaped engaging parts 62*i* that are formed on the frame part Fr2. As a result, the arms am1, am2 bias the roller shaft part 49*b*, 51*b* toward the bottom wall 131, and the roller shaft part 49*b*, 51*b* is pressed again an abutting surface Sp formed on the bottom wall 131. As a result, the spring sp1, sp2 bias with a predetermined biasing force the pinch roller 49, 51 toward the bottom wall 131.

In the frame part Fr1, on a more inner side than the roller regulating part 62*g* on the bottom wall 131, an opening 62*k* is formed. The pinch roller 49, 51 is biased by the biasing force of the spring sp1, sp2 and is caused to protrude from the guiding surface Sb via the opening 62*k* toward the carrying roller 48, 50 side. In the state in which the drawer unit 60 is arranged inside the apparatus body, the carrying roller 48 and the pinch roller 49 are in contact with each other via the openings 61*e*, 62*k*; and the carrying roller 50 and the pinch roller 51 are in contact with each other via the openings 61*f*, 62*k*. In the state in which the drawer unit 60 is pulled out from the apparatus body, the roller parts 49*a*, 51*b* of the pinch rollers 49, 51 are caused to protrude downward from the bottom wall 131. When a reference numeral symbol r1 denotes a radius of the roller part 49*a*, 51*a*; a reference numeral symbol r2 denotes a radius of the roller shaft part 49*b*, 51*b*; and a reference numeral symbol δ1 denotes a thickness of the bottom wall 131, a protrusion amount ϵ of the roller part 49*a*, 51*a* from the opening 61*e*, 62*k* is $\epsilon = r1 - (r2 + \delta 1)$.

Further, on the rear ends of the side edge parts 112, 113 and at positions a predetermined distance Ld1 (<La1) forward from the rear end of the guide part 111, boss parts 63 as first engaged elements are formed in a manner protruding outward. Further, on lower edges of the side edge parts 112, 113, belt-like flanges 61*h* as second engaged elements are formed that extend along the side edge parts 112, 113 and protrude outward. The flanges 61*h* are each provided with a body part 61*i* that is formed by extending horizontally and a valley part 61*j* as a height difference forming part that forms a height difference at an front end of the body part 61*i*.

Next, operations of the drawer unit 60 and the sensor lever 53 when the drawer unit 60 is pulled out from the apparatus body are described.

Figure 22:
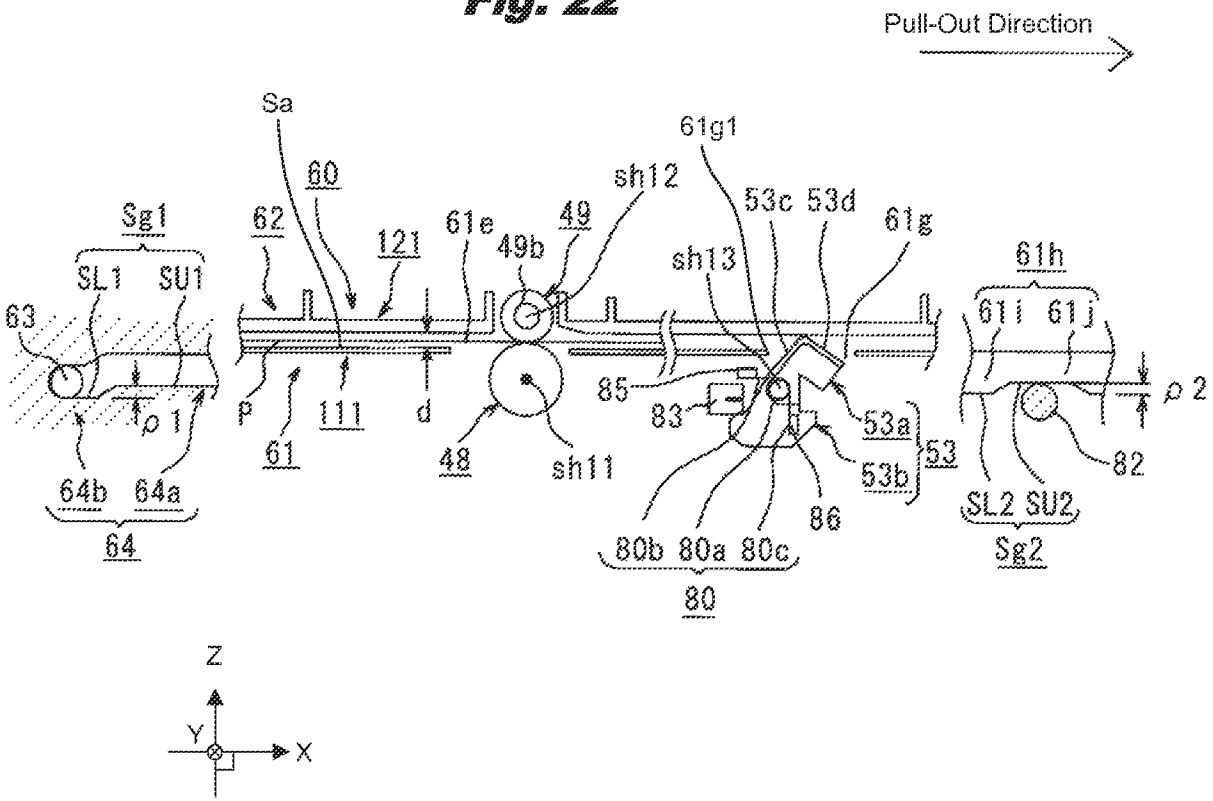
FIG. 22 illustrates a state of a drawer unit and a sensor lever when the drawer unit is arranged in an apparatus body in the first embodiment of the present invention.
Figure 23:
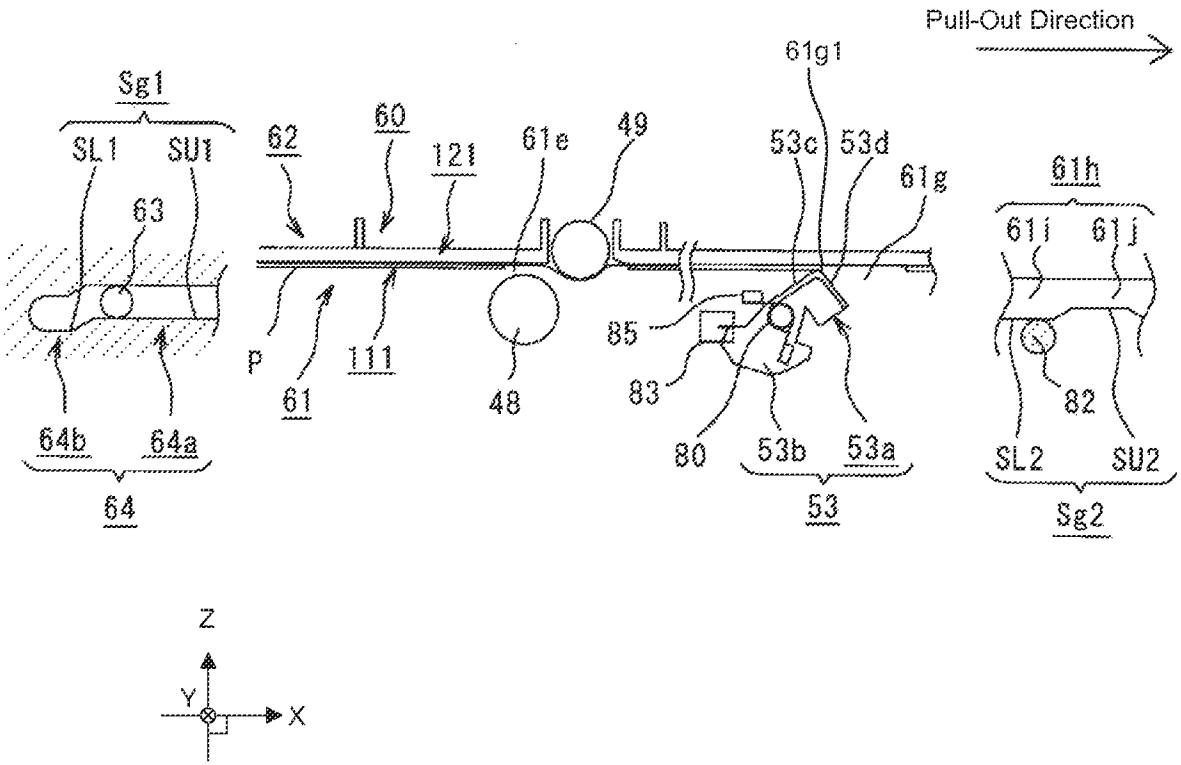
FIG. 23 illustrates a state of the drawer unit and the sensor lever when the drawer unit is pulled out for a predetermined amount from the apparatus body in the first embodiment of the present invention.

FIG. 22 illustrates a state of a drawer unit and a sensor lever when the drawer unit is arranged in an apparatus body in the first embodiment of the present invention. FIG. 23 illustrates a state of the drawer unit and the sensor lever when the drawer unit is pulled out for a predetermined amount from the apparatus body in the first embodiment of the present invention. The carrying roller 50 and the pinch roller 51 have the same structures as those of carrying roller 48 and the pinch roller 49 and thus are not illustrated in the drawings.

In the drawings, a reference numeral symbol 48 denotes a carrying roller; a reference numeral symbol 49 denotes a pinch roller; a reference numeral symbol 53 denotes a sensor lever; a reference numeral symbol 60 denotes a drawer unit; a reference numeral symbol 61 denotes a horizontal carrying plate; a reference numeral symbol 62 denotes a horizontal carrying frame; reference numeral symbols 111, 121 denote guide parts; and a reference numeral symbol 83 denotes a sensor that is arranged adjacent to the sensor lever 53 and generates a detection signal and sends the detection signal to the controller when the sheet P is detected by the sensor lever 53. In the present embodiment, as the sensor 83, an optical sensor is used.

The carrying rollers 48, 50 (FIG. 1) are both rotatably arranged with respect to the apparatus body in a state in which rotation shafts sh11 are fixed at predetermined positions, and are both caused to rotate in response to the rotation of the reversed medium motor.

Further, the pinch rollers 49, 51 are both arranged in a manner that rotation shafts sh12 of the roller shaft parts 49*b*, 51*b* are movable with respect to the guide part 121 in the up-down direction (or Z direction) and are rotatable, and, in the state in which the drawer unit 60 is arranged inside the apparatus body, are caused to rotate (to be driven to rotate) in response to the rotations of the carrying rollers 48, 50. Therefore, as described above, the carrying roller 48 and the pinch roller 49 are in contact with each other via the openings 61*e*, 62*k*, and the carrying roller 50 and the pinch roller 51 are in contact with each other via the openings 61*f*, 62*k*. The openings 61*e*, 61*f* are formed in such shapes that, when the horizontal carrying plate 61 moves between the lower position in the vertical direction and the upper position in the vertical direction, the horizontal carrying plate 61 and the carrying rollers 48, 50 do not interfere with each other. Namely, when the horizontal carrying plate 61 moves up or down, the openings 61*e* and 61*f* do not contact the carrying rollers 48, 50/

The sensor lever 53 is swingably arranged with respect to the apparatus body in a state in which a pivot shaft sh13 is fixed at a predetermined position. In the state in which the drawer unit 60 is arranged inside the apparatus body, the sensor lever 53 protrudes via the opening 61*g* to the reversed medium carrying route Rt4, is pressed against the guide part 121, and is pushed and brought down by the sheet P when the sheet P passes through between the horizontal carrying plate 61 and the horizontal carrying frame 62. Further, the sensor lever 53 is pushed and brought down by the guide part 111 when the drawer unit 60 is pulled out from the apparatus body in a direction an arrow (pull-out direction) or is inserted into the apparatus body.

Therefore, the sensor lever 53 is provided with a passive part 53*a* that is in contact with the carried sheet P and the guide part 111 as a position above the pivot shaft sh13 (on the drawer unit 60 side), and a detection actuating part 53*b* that, along with swinging, selectively shields one of a light emitting side and a light receiving side of the sensor 83 at a position below the pivot shaft sh13. On the passive part 53*a*, a contact surface 53*c* and a contact surface 53*d* are formed. The contact surface 53*c* is in contact with the front end of the sheet P when the sheet P passes through and is in contact with a portion 61*g*1 of an inner peripheral edge of the opening 61*g* on an upstream side in the pull-out direction of the drawer unit 60 when the drawer unit 60 is pulled out from the apparatus body. The contact surface 53*d* is in contact with the rear end of the guide part 111 when the drawer unit 60 is inserted into the apparatus body.

Further, on the sensor lever 53, a torsion spring 80 as a bias member is arranged that biases the passive part 53*a* toward the guide part 121 and causes the passive part 53*a* to be in contact with a back surface of the guide part 121. The torsion spring 80 is provided with a winding part 80*a* and a first and a second arms 80*b*, 80*c* that extend from the winding part 80*a* and is attached to the apparatus body by externally fitting the winding part 80*a* to a shaft part of the pivot shaft sh13, bringing a front end of the first arm 80*b* into contact with a contact part 85 that is formed at a predetermined place of the apparatus body, and bringing a front end of the second arm 80*c* into contact with a contact part 86 that is formed on the detection actuating part 53*b*.

Therefore, by the biasing force of the torsion spring 80, the sensor lever 53 is pressed against the guide part 121.

Figure 32:
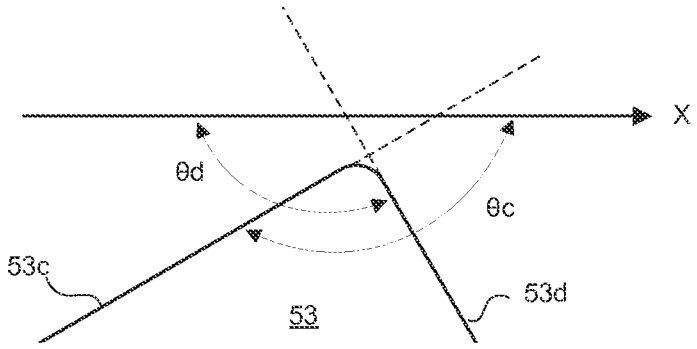
FIG. 32 illustrates angles (θc and θd) formed between the sensor lever and a pull out direction of the drawer unit according to the first embodiment.

When the drawer unit 60 is pulled out from the apparatus body or is inserted into the apparatus body, in order to allow the sensor lever 53 to be smoothly brought down, in the state in which the passive part 53*a* is in contact with the guide part 111, the contact surface 53*c* is inclined in a manner forming an obtuse angle (θ d) with respect to a direction along which the drawer unit 60 is pulled out from the apparatus body (+X direction), and the contact surface 53*d* is inclined in a manner forming an obtuse angle (θ c) with respect to a direction along which the drawer unit 60 is inserted into the apparatus body (−X direction). The concepts of the angles (θ c and θ d) are illustrated in FIG. 32.

Further, in an upstream side and a downstream side of the opening 61*g* in the pull-out direction of the drawer unit 60, other openings are not formed. Therefore, when the drawer unit 60 is being pulled out from the apparatus body or is being inserted into the apparatus body, the sensor lever 53 does not protrude via an opening other than the opening 61*g* to the reversed medium carrying route Rt4.

Hereinafter, a unit lead part that generates the above gap d, which is formed between the horizontal carrying plate 61 and frame 62, will be explained. In the embodiment, the main components of the unit lead part are grooves 64 and guidepost 82 on the apparatus body side, boss parts 63 and flanges 61*h* on the medium guide part side. See FIGS. 22 and 23. On wall surfaces adjacent to the drawer unit 60 in the apparatus body, grooves 64 as first engaging elements are formed that extend along an insertion and removal direction of the drawer unit 60. The grooves 64 (or lead surface) and the boss parts 63 (or projection part) are respectively engaged with each other.

Further, on the wall surfaces adjacent to the drawer unit 60 in the apparatus body, guidepost 82 as second engaging elements formed that protrude toward the drawer unit 60 side and are engaged with the flanges 61*h*. In FIGS. 22 and 23, the same hatching is applied on structures (64 and 82) corresponding to the wall surfaces.

In order to allow the horizontal carrying plate 61 to move in the up-down direction along with the insertion or removal of the drawer unit 60, the grooves 64 are each provided with a body part 64*a* that is formed by extending horizontally and an eccentric part 64*b* as a height difference formation part that is formed to be slightly eccentric downward with respect to the body part 64*a* at a rear end of the body part 64*a* and forms a height difference. On a lower surface of the groove 64, a first guiding surface Sg1 is formed for allowing the horizontal carrying plate 61 to move in the up-down direction along with the insertion or removal of the drawer unit 60. The first guiding surface Sg1 includes an upper guide part SU1 (or second lead part) that is formed in the body part 64*a* and a lower guide part SL1 (first lead part) that is formed, in the eccentric part 64*b*, a height difference amount p1 (represented by a predetermined distance, see FIG. 22) below the upper guide part SU1. The upper guide part SU1 and the lower guide part SL1 are connected by an obliquely extending inclined part.

Further, in order to allow the horizontal carrying plate 61 to move in the up-down direction along with the insertion or removal of the drawer unit 60, as described above, the flange 61*h* is provided with the body part 61*i* that is formed extending horizontally and the valley part 61*j* that is formed at the front end of the body part 61*i*. On a lower surface of the flange 61*h*, a second guiding surface Sg2 is formed for allowing the horizontal carrying plate 61 to move in the up-down direction along with the insertion or removal of the drawer unit 60. The second guiding surface Sg2 includes a lower guide part SL2 that is formed in the body part 61*i* and an upper guide part SU2 that is formed, in the valley part 61*j*, a height difference amount ρ2 (represented by a predetermined distance) above the lower guide part SL2. The lower guide part SL2 and the upper guide part SU2 are connected by an obliquely extending inclined part.

The height difference amounts ρ1, ρ2 obey ρ1=ρ2.

In the present embodiment, in the state in which the drawer unit 60 is arranged inside the apparatus body, the carrying roller 48 and the pinch roller 49 are in contact with each other via the openings 61*e*, 62*k*; and the carrying roller 50 and the pinch roller 51 are in contact with each other via the openings 61*f*, 62*k*. However, the rotation shaft sh11 of each of the carrying rollers 48, 50 i arranged in the apparatus body in a state of being rotatably fixed at a predetermined position. Therefore, the pinch rollers 49, 51 are placed in a state of being respectively placed on the carrying rollers 48, 50.

Figure 34:
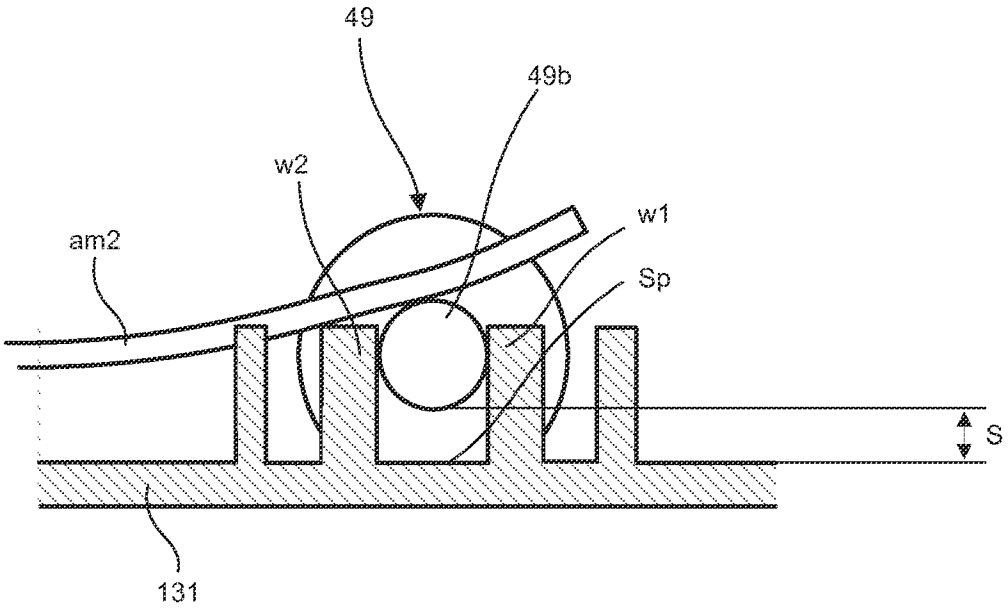
FIG. 34 illustrates a distance S between roller shaft part 49*b* and abutting surface Sp that is created where the drawer unit 60 is not inserted.

Further, the boss part 63 is placed in the eccentric part 64*b*; the guidepost 82 is placed in the valley part 61*j*; and the horizontal carrying plate 61 is placed at the lower position in the vertical direction. In this case, when a resultant force of the biasing force with which the spring sp1 biases the pinch roller 49 toward the bottom wall 131 and the biasing force with which the spring sp2 biases the pinch roller 51 toward the bottom wall 131 is Fs, and a force that is generated due to a weight of the horizontal carrying frame 62 and tends to separate the pinch rollers 49, 51 from the bottom wall 131 is Fm, Fs=Fm holds. In this case, the springs sp1, sp2 deflect a predetermined amount; and the roller shaft part 49*b* is separated from the abutting surface Sp of the bottom wall 131 for a predetermined distance S, see FIG. 34. Therefore, the horizontal carrying frame 62 has its own weight supported by the springs sp1, sp2. In a state in which the drawer unit 60 is mounted in the apparatus body and is placed at a position illustrated in FIG. 22, the distance S is smaller than the protrusion amount ϵ so that the gap d is formed between the horizontal carrying plate 61 and the horizontal carrying frame 62. The status of the medium guide unit illustrated in FIG. 22 is defined as a fitting position, where the boss part 63 is fit in the eccentric part 64*b* (or contacts the lower guide part SL1), and the guide post 82 of the wall is fit in the valley part 61*j*. In other words, the medium guide unit is fully fit in the apparatus body in the status. In this position, the carrying rollers (48, 50) and pinch rollers (49, 51) are respectively in contact.

Further, when the drawer unit 60 is pulled out from the apparatus body, as illustrated in FIG. 23, along with the movement of the drawer unit 60 in the horizontal direction, the boss part 63 is moved from the eccentric part 64*b* from the body part 64*a* and is in contact with the upper guide part SU1 of the first guiding surface Sg1; and further, the guidepost 82 is moved from the valley part 61*j* to the body part 61*i* and is in contact with the lower guide part SL2 of the second guiding surface Sg2. The other status of the medium guide unit illustrated in FIG. 23 is defined as a moving position, where the boss part 63 is dislocated from the eccentric part 64*b*, and is positioned in the body part 64*a* (or contact the upper guide part SU1). As the time, the guide post 82 has been moved from the valley part 61*j* to body part 61*i*. The moving position may be regarded a transitional position of the medium guide unit that is from the fitting position up to another position where the medium guide unit is fully pulled out of the apparatus body. In this position, the carrying rollers (48, 50) and pinch rollers (49, 51) are not respectively in contact.

Along with this, the horizontal carrying plate 61 is moved upward and is placed at the upper position in the vertical direction. As a result, the sheet P is sandwiched by the guide part 111 of the horizontal carrying plate 61 and the guide part 121 of the horizontal carrying frame 62 and the gap d disappears. Therefore, when sheet jam occurs in the reversed medium carrying part AR2 (FIG. 1), the drawer unit 60 can be pulled out from the apparatus body in a state in which the sheet P is sandwiched between the horizontal carrying plate 61 and the horizontal carrying frame 62.

In this case, the positions of the eccentric part 64*b* and the valley part 61*j* are set in such a manner that the timing at which the boss part 63 is brought into contact with the upper guide part SU1 and the timing at which the guidepost 82 is brought into contact with the lower guide part SL2 are substantially the same. A pull-out amount of the drawer unit 60 is set based on lengths of the body parts 64*a*, 61*i*.

In the present embodiment, the height difference amounts ρ1, ρ2, the gap d and the dimensions L1, L2 are equal to each other. However, it is also possible that the height difference amounts ρ1, ρ2 are equal to or greater than the gap d and the dimensions L1, L2 are equal to or greater than the height difference amounts ρ1, ρ2. By making the height difference amounts ρ1, ρ2 equal to or greater than the gap d and the dimensions L1, L2 equal to or greater than the height difference amounts ρ1, ρ2, when sheet jam occurs in the reversed medium carrying part AR2, the horizontal carrying plate 61 can be sufficiently moved upward and the drawer unit 60 can be pulled out in a state in which the sheet P is surely sandwiched between the apparatus body horizontal carrying plate 61 and the horizontal carrying frame 62.

Further, when the drawer unit 60 is inserted into the apparatus body, the boss part 63 is moved from the body part 64*a* to the eccentric part 64*b*, and the guidepost 82 is moved from the body part 61*i* to the valley part 61*j*. Along with this, the gap d is formed between the horizontal carrying plate 61 and the horizontal carrying frame 62.

In this way, in the present embodiment, the drawer unit 60 is insertably and removably arranged with respect to the apparatus body. When the drawer unit 60 is pulled out from the apparatus body, the pinch rollers 49, 51 and the carrying rollers 48, 50 are separated from each other. Therefore, when sheet jam occurs between the horizontal carrying plate 61 and the horizontal carrying frame 62, the sheet P can be easily taken out by just pulling out the drawer unit 60 from the apparatus body. In addition, the drawer unit 60 has small dimensions and is light. Therefore, an operation to take the sheet P out from between the horizontal carrying plate 61 and the horizontal carrying frame 62 can be easily performed.

Further, the drawer unit 60 is insertably and removably arranged with respect to the apparatus body on the front casing part Cf side, that is, one the front side of the printer 10 (FIG. 2). Therefore, the operation to take the sheet out can be even more easily performed.

In the present embodiment, the elongated holes 61*a*, 61*b* are formed by extending vertically (or Z direction). Therefore, the horizontal carrying plate 61 can be moved in a vertical direction between the lower position in the vertical direction and the upper position in the vertical direction. Therefore, as the drawer unit 60 is pulled out from the apparatus body, the direction along which the horizontal carrying plate 61 is moved toward the horizontal carrying frame 62 is substantially perpendicular to the direction along which the drawer unit 60 is pulled out from the apparatus body.

The direction along which the horizontal carrying plate 61 moves between the lower position and the upper position in the vertical direction is substantially perpendicular to the direction along which the drawer unit 60 is inserted into or pulled out from the apparatus body. The angle along which the horizontal carrying plate 61 moves may be ranged within 80 degrees to 100 degrees. Thereby, the elongated holes 61*a*, 61*b* may be inclined +/−10 degrees with respect to the vertical direction.

Next, a second embodiment of the present invention, in which the drawer unit 60 is insertably and removably arranged with respect to the apparatus body on the rear casing part Cr side, is described. A component having a same structure as in the first embodiment is indicated using the same reference numeral symbol and, for an effect of the invention due to having the same structure, the effect of the first embodiment is incorporated.

Figure 24:
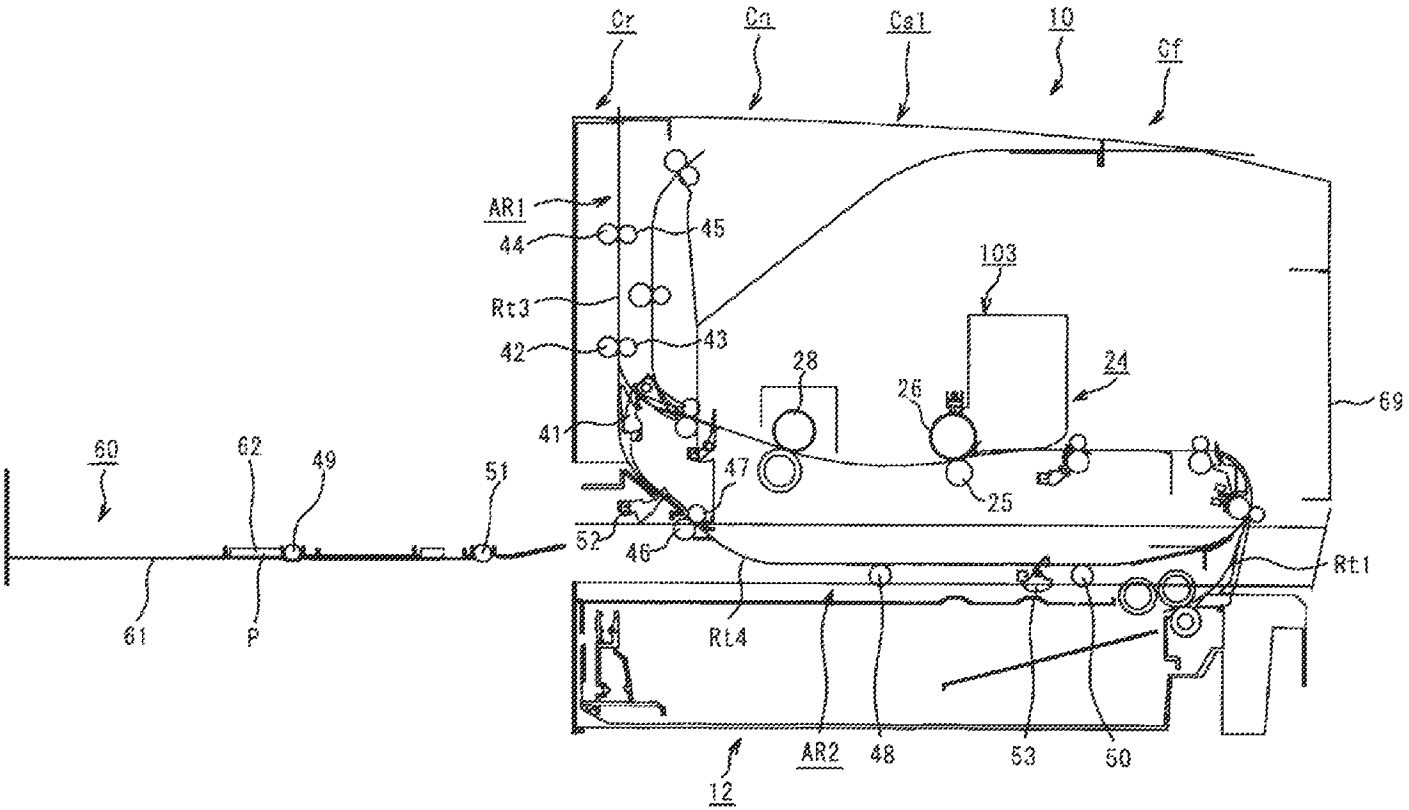
FIG. 24 illustrates a first schematic diagram of a printer for describing a method for taking out a sheet from a reversed medium carrying part in a second embodiment of the present invention.
Figure 25:
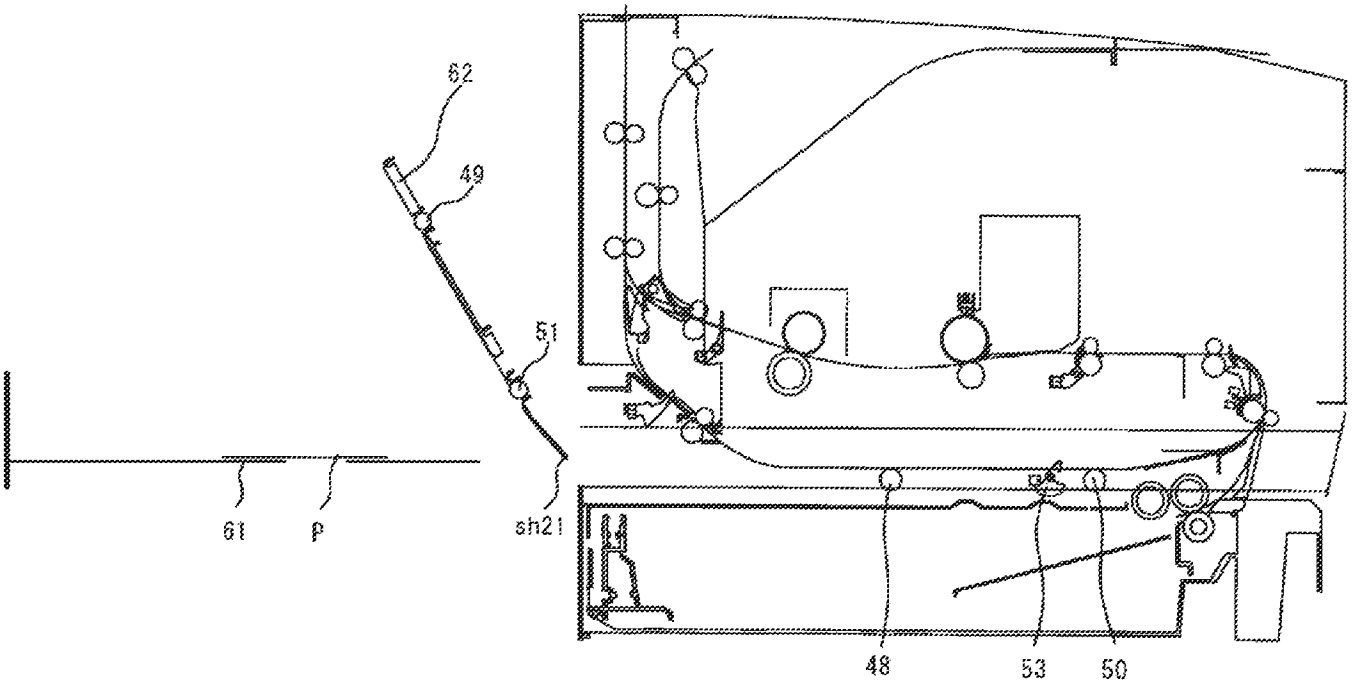
FIG. 25 is a second schematic diagram of the printer for describing the method for taking out a sheet from the reversed medium carrying part in the second embodiment of the present invention.
Figure 26:
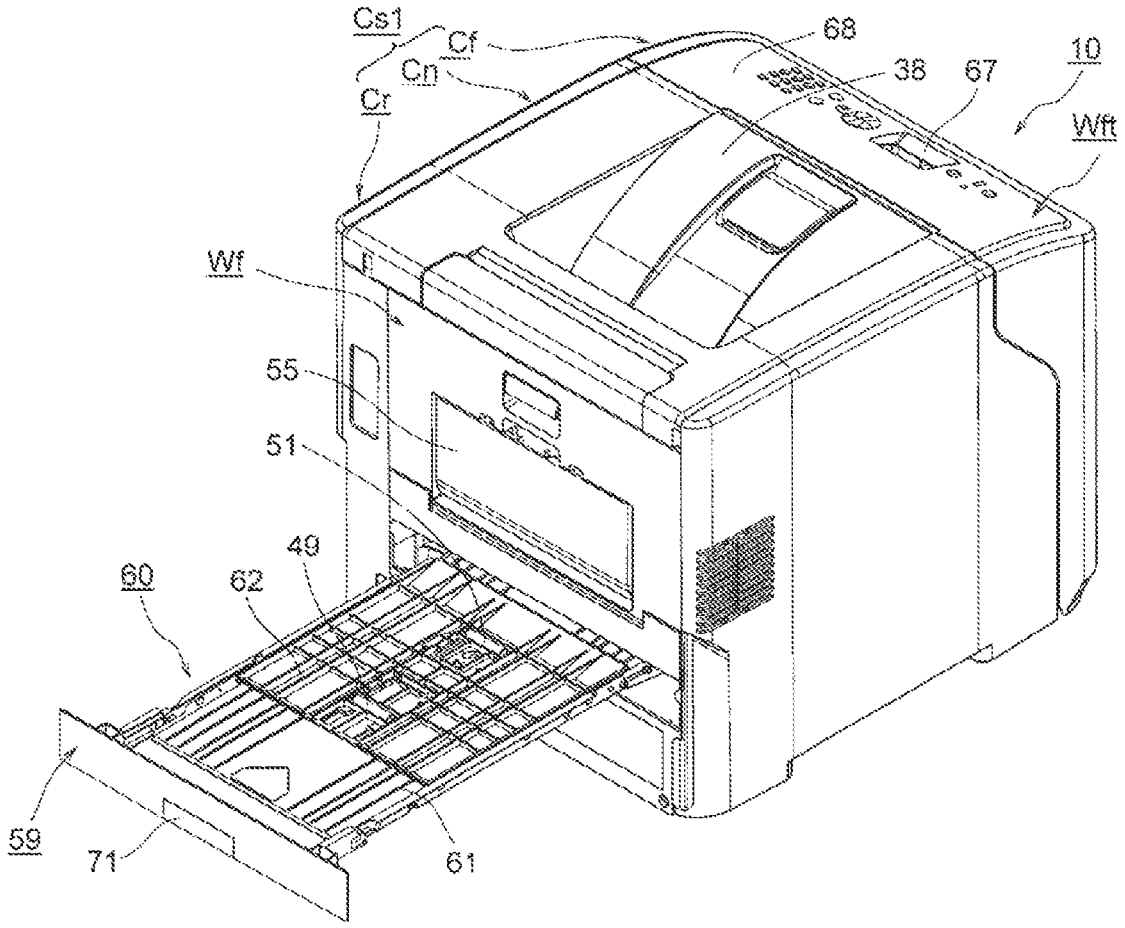
FIG. 26 illustrates a first perspective view of the printer for describing the method for taking out a sheet from the reversed medium carrying part in the second embodiment of the present invention.
Figure 27:
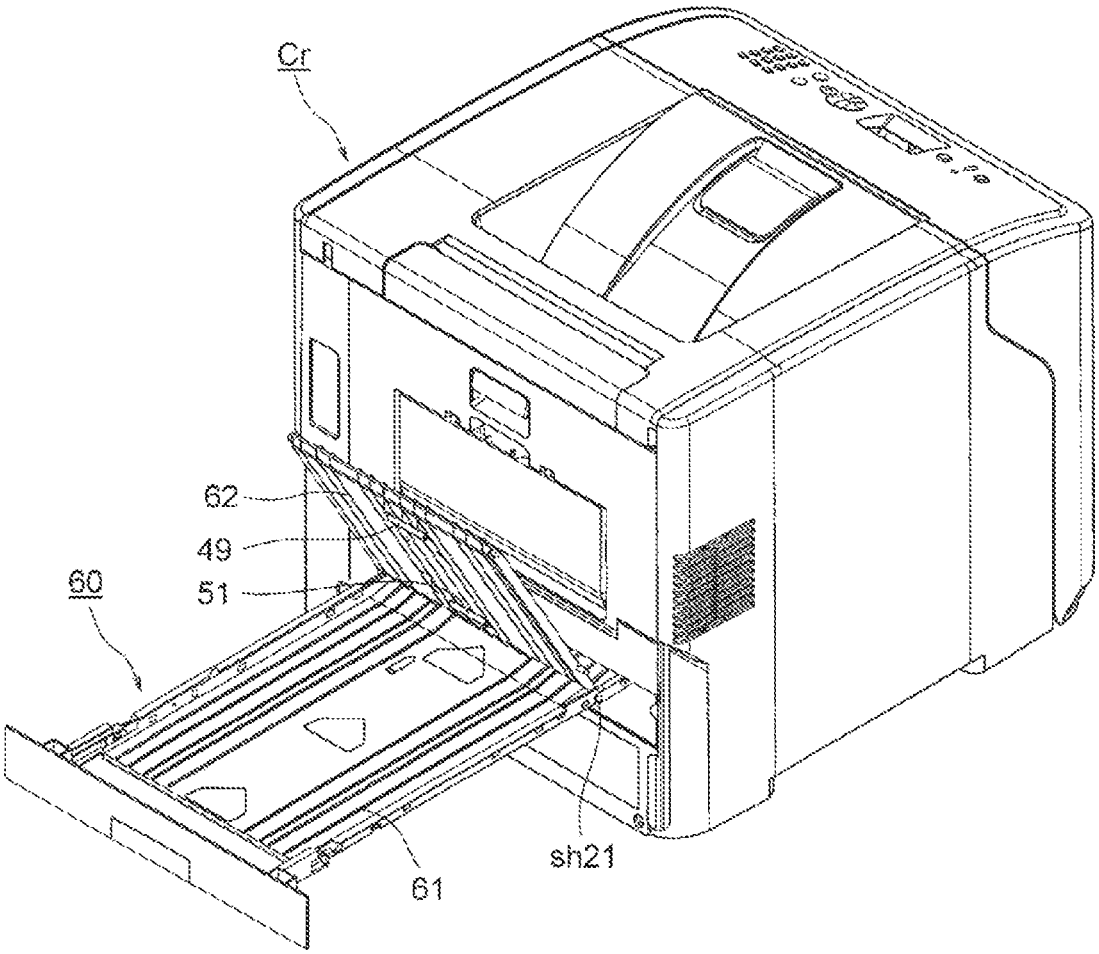
FIG. 27 illustrates a second perspective view of the printer for describing the method for taking out a sheet from the reversed medium carrying part in the second embodiment of the present invention.

FIG. 24 illustrates a first schematic diagram of a printer for describing a method for taking out a sheet from a reversed medium carrying part in a second embodiment of the present invention. FIG. 25 is a second schematic diagram of the printer for describing the method for taking out a sheet from the reversed medium carrying part in the second embodiment of the present invention. FIG. 26 illustrates a first perspective view of the printer for describing the method for taking out a sheet from the reversed medium carrying part in the second embodiment of the present invention. FIG. 27 illustrates a second perspective view of the printer for describing the method for taking out a sheet from the reversed medium carrying part in the second embodiment of the present invention.

In the drawings, a reference numeral symbol 10 denotes a printer. A reference numeral symbol Cs1 denotes a casing of the printer 10. The casing Cs1 includes a central casing part Cn as a first casing part that is arranged at a center of the printer 10, a front casing part Cf as a second casing part that is swingably and openably/closably arranged with respect to the central casing part Cn in front of the central casing part Cn, and a rear casing part Cr as a third casing part that is detachably arranged with respect to the central casing part Cn in rear of the central casing part Cn.

Further, a reference numeral symbol 55 denotes a rear cover as a rear opening and closing member that is swingably and openably/closably arranged on a central part of the back wall Wr of the rear casing part Cr. A reference numeral symbol 60 denotes a drawer unit as a medium guide unit and as an insertable and removable member that is arranged below the rear cover 55 on the back wall Wr to be insertable and removable with respect to the apparatus body and movable in the horizontal direction. A reference numeral symbol 59 denotes a panel of the drawer unit 60. A reference numeral symbol 71 denotes a knob as an operation part that is arranged at a predetermined place of the panel 59, in the present embodiment, arranged at a lower edge of the panel 59, for pulling out the drawer unit 60.

Next, a method for taking out a sheet from the reversed medium carrying part AR2 when sheet jam occurs in the reversed medium carrying part AR2 is described.

When sheet jam occurs in the reversed medium carrying part AR2, an message indicating that sheet jam has occurred in the reversed medium carrying part AR2 is displayed in the operation panel 67 to inform the operator. As a result, the operator operates to pull the knob 71 arranged on the panel 59 and thereby, as illustrated in FIGS. 24 26, the drawer unit 60 can be pulled out from the apparatus body.

In this case, the pinch rollers 49, 51 as the first and second driven rollers are arranged on the drawer unit 60, and the carrying rollers 48, 50 as the first and second driving rollers and the sensor lever 53 as the fifth medium detection part are arranged in the apparatus body. Therefore, along with pulling the drawer unit 60 out from the apparatus body, the carrying rollers 48, 50 and the pinch rollers 49, 51 can be separated and the sheet P as the medium, together with the drawer unit 60, can also be pulled out from the apparatus body.

As illustrated in FIGS. 25 and 27, the operator opens the horizontal carrying frame 62 as the second guide member by rotating the horizontal carrying frame 62 about a pivot shaft sh21 so that the sheet P can be taken out.

Next, the drawer unit 60 is described.

Figure 28:
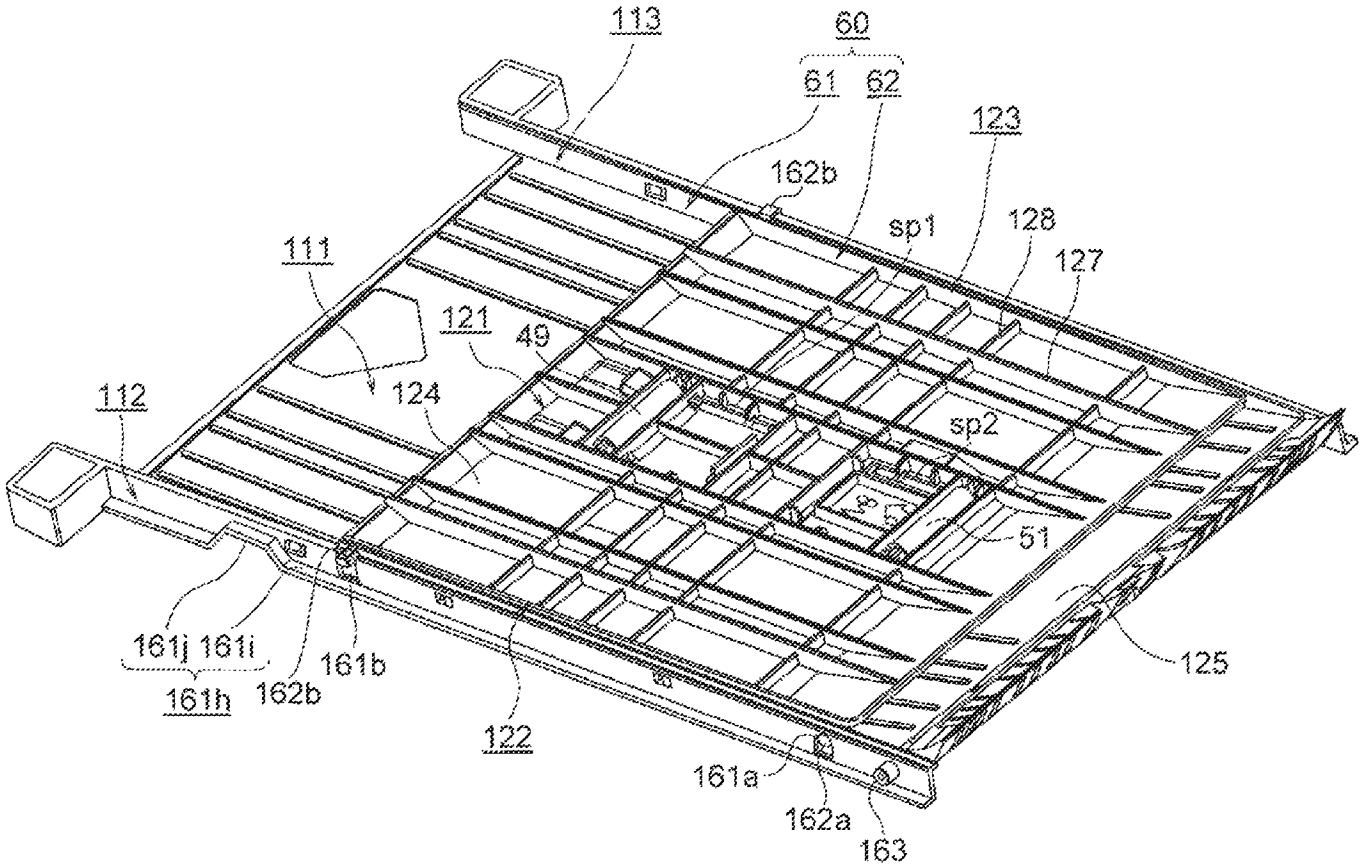
FIG. 28 illustrates a perspective view of a drawer unit in the second embodiment of the present invention.
Figure 29:
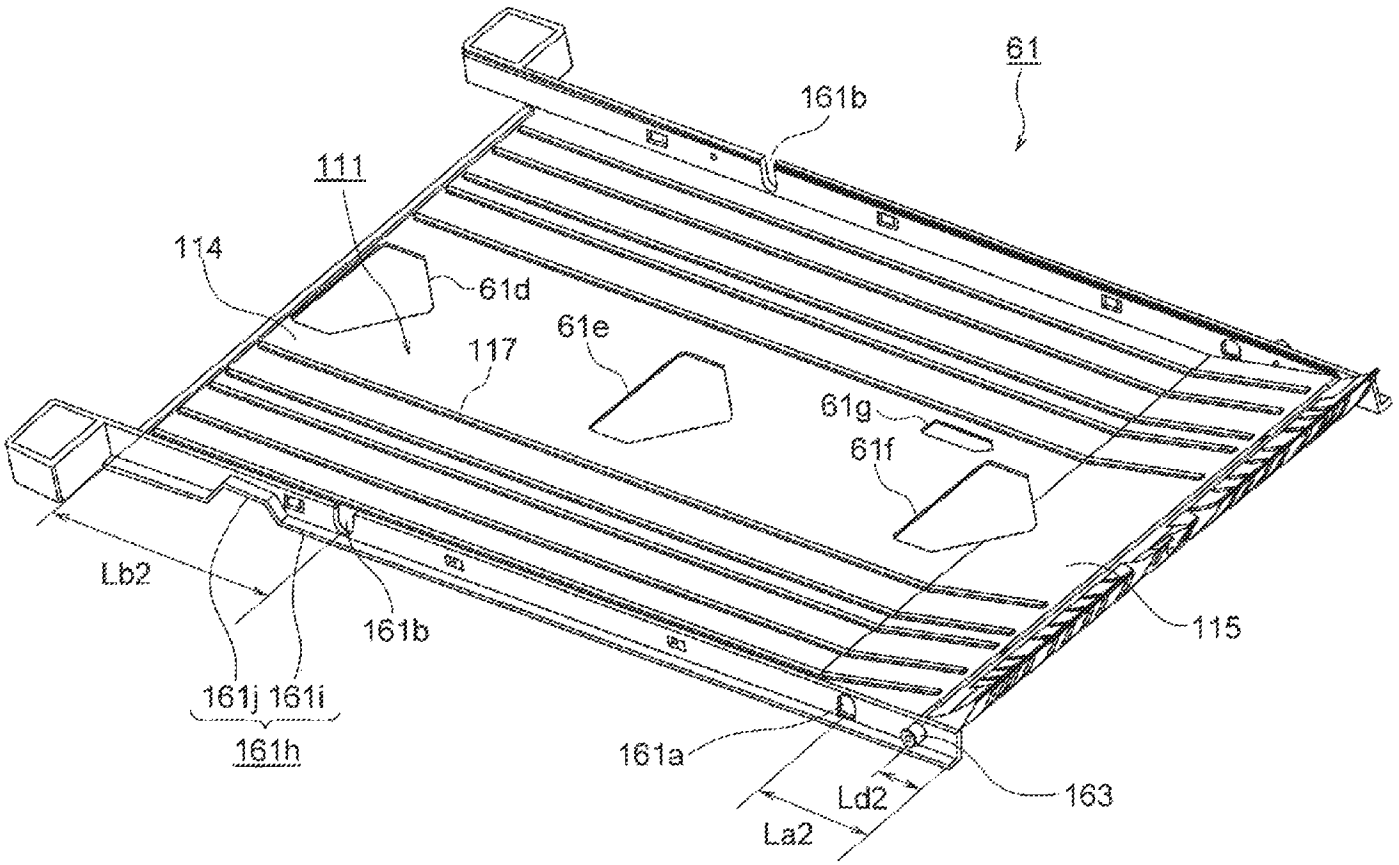
FIG. 29 illustrates a perspective view of a horizontal carrying plate in the second embodiment of the present invention.

FIG. 28 illustrates a perspective view of a drawer unit in the second embodiment of the present invention. FIG. 29 illustrates a perspective view of a horizontal carrying plate in the second embodiment of the present invention.

In the drawings, a reference numeral symbol 60 denotes a drawer unit; a reference numeral symbol 61 denotes a horizontal carrying plate as a first guide member; and a reference numeral symbol 62 denotes a horizontal carrying frame.

The horizontal carrying plate 61 is provided with a guide part 111 guiding the sheet P, and side edge parts 112, 113 that are erected and formed at both edges of the guide part 111. The horizontal carrying frame 62 is provided with a guide part 121 guiding the sheet P, and side edge parts 122, 123 that are erected and formed at both edges of the guide part 121.

In order to allow the sheet P to pass through between the horizontal carrying plate 61 and the horizontal carrying frame 62, in the state in which the drawer unit 60 is arranged inside the apparatus body, a predetermined gap d (FIG. 22) is formed between the horizontal carrying plate 61 and the horizontal carrying frame 62. When the drawer unit 60 is pulled out from the apparatus body or is inserted into the apparatus body, to prevent the drawer unit 60 from interfering with the carrying rollers 48, 50 (FIG. 24), the sensor lever 53 and the like, the horizontal carrying plate 61 is moved toward the horizontal carrying frame 62 and is brought into contact with the horizontal carrying frame 62 via the sheet P, and the gap d disappears (becomes 0).

Further, in the drawer unit 60 that is pulled out from the apparatus body, in order to allow the sheet P jammed between the horizontal carrying plate 61 and the horizontal carrying frame 62 to be taken out, the horizontal carrying frame 62 is swingably supported with respect to the horizontal carrying plate 61.

Therefore, in the horizontal carrying plate 61, at predetermined positions on the side edge parts 112, 113, in the present embodiment, at positions a predetermined distance La2 rearward from a front end of the guide part 111, elongated holes 161*a* as first supporting parts having a predetermined shape, in the present embodiment, an O-shaped shape, are formed by long grooves; and at positions a predetermined distance Lb2 forward from a rear end of the guide part 111, elongated holes 161*b* as second supporting parts having a predetermined shape, in the present embodiment, a U-shaped shape with an opening upper end, are formed by long grooves.

Further, in the horizontal carrying frame 62, at predetermined positions on the side edge parts 122, 123, in the present embodiment, on the front end of the guide part 121, post parts 162*a* as first supported parts having a predetermined shape, in the present embodiment, a column-shaped shape, are formed in a manner protruding toward outside of both edges of the guide part 121; and on the rear end of the guide part 121, post parts 162*b* as second supported parts having a predetermined shape, in the present embodiment, a shape of a rectangular column, are formed in a manner protruding toward outside of both edges of the guide part 121.

Further, when a reference numeral symbol zw1 denotes a dimension of the elongated holes 161*a* in the horizontal direction (the carrying direction of the sheet P), that is, a width, a reference numeral symbol zh1 denotes a dimension of the elongated holes 161*a* in a perpendicular direction, that is, a height, and a reference numeral symbol zd1 denotes a diameter of the post parts 162*a*, the width zw1 is slightly greater than the diameter zd1, and the height zh1 is greater than the diameter zd1 by a predetermined dimension L1 (FIG. 17). Further, when a reference numeral symbol zw2 denotes a width of the elongated holes 161*b*, a reference numeral symbol zh2 denotes a height o the elongated holes 161*b*, and a reference numeral symbol zd2 denotes a diameter of the post parts 162*b*, the width zw2 is slightly greater than the diameter zd2, and the height zh2 is greater than the diameter sd2 by a predetermined dimension L2. In the present embodiment, the dimensions L1, L2 obey L1=L2.

Therefore, by fitting (or loosely mating) the post parts 162*a* into the elongated holes 161*a* in a manner movable in a up-down direction, and fitting the post parts 162*b* into the elongated holes 161*b* in a manner movable in the up-down direction, the horizontal carrying plate 61 and the horizontal carrying frame 62 can be allowed to relatively move in the up-down direction. That is, in the state in which the drawer unit 60 is arranged inside the apparatus body, the horizontal carrying plate 61 is placed at a lower position in the vertical direction as a first position so as to allow the sheet P to pass through, and a predetermined gap is formed between the horizontal carrying plate 61 and the horizontal carrying frame 62. Further, when the drawer unit 60 is pulled out from the apparatus body or is inserted into the apparatus body, the horizontal carrying plate 61 is placed as an upper position in the vertical direction as a second position and is brought to be in contact with the horizontal carrying frame 62, and the gap disappears (becomes 0). As a result, when the drawer unit 60 is pulled out from the apparatus body or is inserted into the apparatus body, the drawer unit 60 does not interfere with the carrying rollers 48, 50, the sensor lever 53 and the like.

Further, the post parts 162*a* are fitted into the elongated holes 161*a*. Therefore, in the drawer unit 60 pulled out from the apparatus body, by rotating the horizontal carrying frame 62 using the post parts 162*a* as the pivot shaft sh21 (FIG. 27), the sheet P jammed between the horizontal carrying plate 61 and the horizontal carrying frame 62 can be taken out.

In the horizontal carrying plate 61, the guide part 111 is provided with a body part 114 that is formed by extending in the horizontal direction; an inclined part 115 that is formed by extending obliquely upward from a front end of the body part 114 and is for guiding the sheet P that passes through the drawer unit 60 to the intermediate carrying roller 16 and the pinch roller 17 as a first carrying member; a plurality of ribs 117 that extend in a carrying direction of the sheet P and are formed at a predetermined distance from each other; and the like. In a flat portion where the ribs 117 are not formed, in a range from a rear end to the front end of the guide part 111, a plurality of, in the present embodiment, three openings 61*d*, 61*e*, 61*f* are formed at a predetermined interval from each other; and an opening 61*g* is formed adjacent to the opening 61*f*. The openings 61*e*, 61*f* are respectively formed at positions corresponding to the pinch rollers 49, 51 that are arranged on the horizontal carrying frame 62. In a state in which the drawer unit 60 is arranged inside the apparatus body, in the reversed medium carrying route Rt4, the carrying roller 48 and the pinch roller 49 are in contact with each other and further the carrying roller 50 and the pinch roller 51 are in contact with each other. Further, in the state in which the drawer unit 60 is arranged inside the apparatus body, the sensor lever 53 is cud to protrude via the opening 61*g* to the reversed medium carrying route Rt4.

Further, in the horizontal carrying frame 62, the guide part 121 is provided with a body part 124 that is formed by extending in the horizontal direction; an inclined part 125 that is formed by extending obliquely upward from a front end of the body part 124 and is for guiding, together with the inclined part 115, the sheet P that passes through the drawer unit 60 to the intermediate carrying roller 16 and the pinch roller 17; a plurality of ribs 127 that extend in the carrying direction of the sheet P and are formed at a predetermined distance from each other; a plurality of ribs 128 that extend in a direction perpendicular to the carrying direction of the sheet P, that is, in a width direction of the guide part 121, and are formed at a predetermined distance from each other; and the like.

At positions on the front end of the guide part 111 that are a predetermined distance Ld2 rearward from the front ends of the side edge parts 112, 113, boss parts 163 as first engaged elements are formed in a manner protruding outward. Further, on lower edges of the side edge parts 112, 113, belt-like flanges 161*h* as second engaged elements are formed that extend along the side edge parts 112, 113 and protrude outward. The flanges 161*h* are each provided with a body part 161*i* that is formed by extending horizontally and a valley part 161*j* as a height difference forming part that forms a height difference at an front end of the body part 161*i*.

Next, operations of the drawer unit 60 and the sensor lever 53 when the drawer unit 60 is pulled out from the apparatus body are described.

Figure 30:
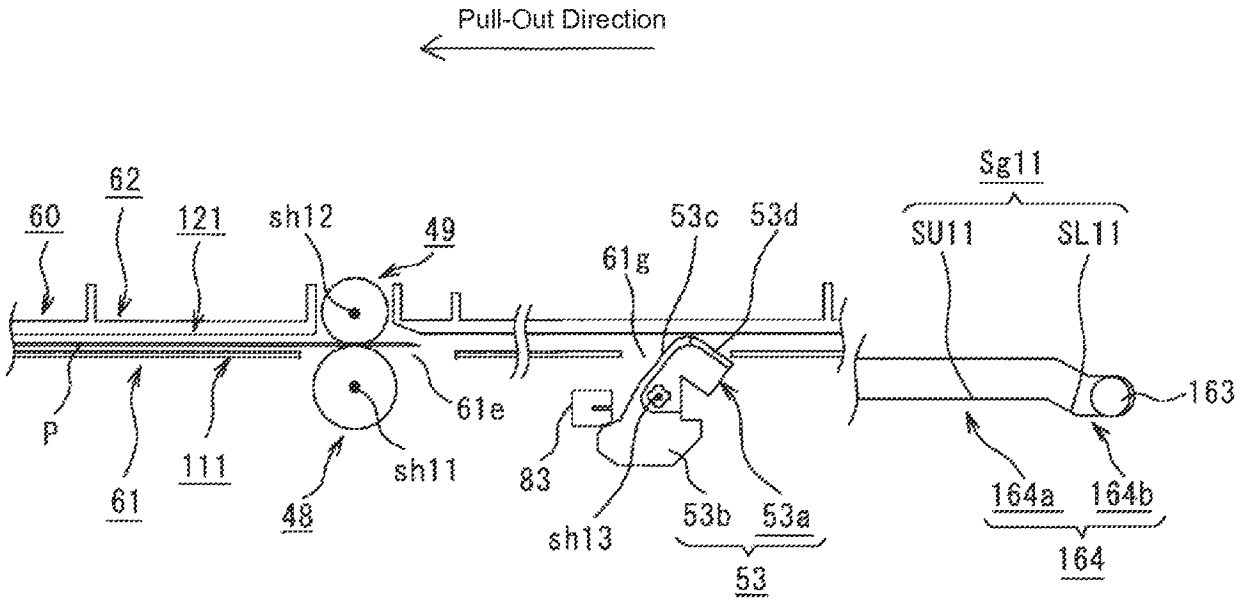
FIG. 30 illustrates a state of a drawer unit and a sensor lever when the drawer unit is arranged in an apparatus body in the second embodiment of the present invention.
Figure 31:
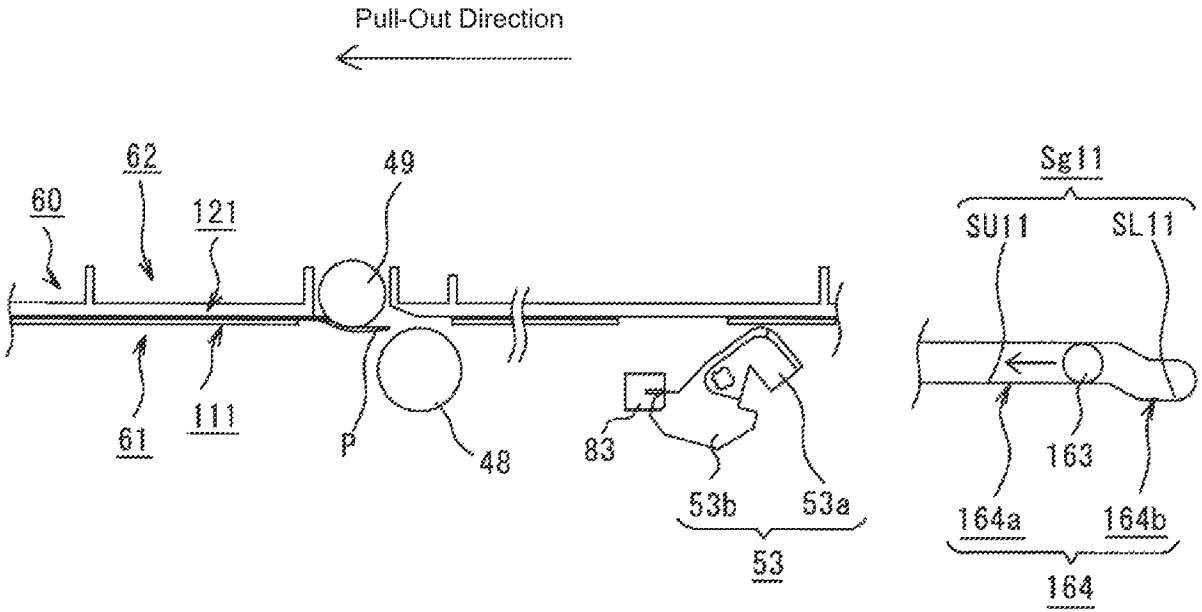
FIG. 31 illustrates a state of the drawer unit and the sensor lever when the drawer unit is pulled out for a predetermined amount from the apparatus body in the second embodiment of the present invention.

FIG. 30 illustrates a state of a drawer unit and a sensor lever when the drawer unit is arranged in an apparatus body in the second embodiment of the present invention. FIG. 31 illustrates a state of the drawer unit and the sensor lever when the drawer unit is pulled out for a predetermined amount from the apparatus body in the second embodiment of the present invention. The carrying roller 50 and the pinch roller 51 are not illustrated in the drawings.

In the drawings, a reference numeral symbol 48 denotes a carrying roller; a reference numeral symbol 49 denotes a pinch roller; a reference numeral symbol 53 denotes a sensor lever; a reference numeral symbol 60 denotes a drawer unit; a reference numeral symbol 61 denotes a horizontal carrying plate; a reference numeral symbol 62 denotes a horizontal carrying frame; reference numeral symbols 111, 121 denote guide parts; and a reference numeral symbol 83 denotes a sensor that is arranged adjacent to the sensor lever 53 and generates a detection signal and sends the detection signal to the controller when the sheet P is detected by the sensor lever 53. In the present embodiment, as the sensor 83, an optical sensor is used.

The carrying rollers 48, 50 (FIG. 24) are both rotatably arranged with respect to the apparatus body in a state in which rotation shafts sh11 are fixed at predetermined positions, and are both caused to rotate in response to the rotation of the reversed medium motor as the driving part for reversed medium carrying.

Further, the pinch rollers 49, 51 are both arranged in a manner that rotation shafts sh12 are movable with respect to the guide part 121 in the up-down direction and are rotatable, and, in the state in which the drawer unit 60 is arranged inside the apparatus body, are caused to rotate (to be driven to rotate) in response to the rotations of the carrying rollers 48, 50.

The sensor lever 53 is swingably arranged with respect to the apparatus body in a state in which a pivot shaft sh13 is fixed at a predetermined position. In the state in which the drawer unit 60 is arranged inside the apparatus body, the sensor lever 53 protrudes via the opening 61*g* to the reversed medium carrying route Rt4 (FIG. 24), is pressed against the guide part 121, and is pushed and brought down by the sheet P when the sheet P passes through between the horizontal carrying plate 61 and the horizontal carrying frame 62. Further, the sensor lever 53 is pushed and brought down by the guide part 111 when the drawer unit 60 is pulled out from the apparatus body or is inserted into the apparatus body.

Therefore, the sensor lever 53 is provided with a passive part 53*a* that is in contact with the carried sheet P and the guide part 111 as a position above the pivot shaft sh13 (on the drawer unit 60 side), and a detection actuating part 53*b* that, along with swinging, selectively shields one of a light emitting side and a light receiving side of the sensor 83 at a position below the pivot shaft sh13. On the passive part 53*a*, a contact surface 53*c* and a contact surface 53*d* are formed. The contact surface 53*c* is in contact with the front end of the sheet P when the sheet P passes through and is in contact with a portion an inner peripheral edge of the opening 61*g* on an upstream side in the pull-out direction of the drawer unit 60 when the drawer unit 60 is pulled out from the apparatus body. The contact surface 53*d* is in contact with the rear end of the guide part 111 when the drawer unit 60 is inserted into the apparatus body.

Further, on the sensor lever 53, a torsion spring 80 (FIG. 22) as a bias member is arranged that biases the passive part 53*a* toward the guide part 121 and causes the passive part 53*a* to be in contact with a back surface of the guide part 121. Therefore, by the biasing force of the torsion spring 80, the sensor lever 53 is pressed against the guide part 121.

On wall surfaces adjacent to the drawer unit 60 in the apparatus body, grooves 164 as first engaging elements are formed that extend along an insertion and removal direction of the drawer unit 60. The grooves 164 and the boss parts 163 are respectively engaged with each other.

Further, as described above, the flanges 161*h* are formed on the lower edges of the side edge parts 112, 113 of the horizontal carrying plate 61. On wall surfaces adjacent to the drawer unit 60 in the apparatus body, guideposts (not illustrated in the drawings) as second engaging elements that protrude toward the drawer unit 60 side are formed and are engaged with the flanges 161*h*.

In order to allow the horizontal carrying plate 61 to move in the up-down direction along with the insertion or removal of the drawer unit 60, the grooves 164 are each provided with a body part 164*a* that is formed by extending horizontally and an eccentric part 164*b* as a height difference formation part that is formed to be slightly eccentric downward with respect to the body part 164*a* at a front end of the body part 164*a* and forms a height difference. On a lower surface of the groove 164, a first guiding surface Sg11 is formed for allowing the horizontal carrying plate 61 to move in the up-down direction along with the insertion or removal of the drawer unit 60. The first guiding surface Sg11 includes an upper guide part SU11 that is formed in the body part 164*a* and a lower guide part SL11 that is formed, in the eccentric part 164*b*, a predetermined distance below the upper guide part SU11. The upper guide part SU11 and the lower guide part SL11 are connected by an obliquely extending inclined part.

Further, as described above, the flange 161*h* is provided with a body part 161*i* and a valley part 161*j* in order to allow the horizontal carrying plate 61 to move in the up-down direction along with the insertion or removal of the drawer unit 60. On a lower surface of the flange 161*h*, a second guiding surface is formed for allowing the horizontal carrying plate 61 to move in the up-down direction along with the insertion or removal of the drawer unit 60. The second guiding surface includes a lower guide part that is formed in the body part 161*i* and an upper guide part that is formed, in the valley part 161*j*, a predetermined distance above the lower guide part. The lower guide part and the upper guide part are connected by an obliquely extending inclined part.

In the above embodiments, the printer 10 is described. However, the present invention can be applied to a copying machine, a facsimile, a multifunction machine, and the like.

The present invention is not limited to the above embodiments. Based on the spirit of the present invention, various modifications are possible, which are not to be excluded from the scope of the present invention.

What is claimed is:

1. An image forming apparatus for forming an image on a print medium, comprising:

an image forming apparatus body having a side wall; and a print medium guide unit that has a print medium carrying path, guides the print medium traveling in the print medium carrying path, and is attached to and pulled out from the image forming apparatus body through the side wall of the image forming apparatus body, the print medium guide unit including a first guide, a second guide, and a swing axis that extends in a direction perpendicular to a print medium carrying direction of the print medium between the first guide and the second guide and that connects the first guide and the second guide, wherein the second guide is swingable about the swing axis with respect to the first guide, and the swing axis is located in the vicinity of a front end of the print medium guide unit in an insertion direction where the print medium guide unit is inserted into the image forming apparatus body.

2. The image forming apparatus according to claim 1, wherein the print medium guide unit is pulled out from a side where the print medium is supplied to the print medium guide unit.

3. The image forming apparatus according to claim 1, wherein a length of the first guide that is determined from the swing axis to a rear end in the insertion direction is longer than a length of the second guide that is determined from the swing axis to a rear end in the insertion direction.

4. The image forming apparatus according to claim 1, wherein the side wall is a rear wall of the image forming apparatus.

5. The image forming apparatus according to claim 1, wherein the first guide has a carrying surface that no rib is formed in a substantially central portion thereof.

6. The image forming apparatus according to claim 1, wherein the first guide includes a first opening in which a roller is present and a second opening in which no roller is present.

7. The image forming apparatus according to claim 1, wherein the first guide is extended longer than the second guide is on an upstream side in the print medium carrying direction.

8. The image forming apparatus according to claim 1, wherein a downstream edge part of the first guide in the print medium carrying direction is inclined diagonally upward.

9. The image forming apparatus according to claim 1, wherein the first guide is longer than the second guide in the print medium carrying direction.

10. The image forming apparatus according to claim 1, wherein the first guide includes an opening in which a carrying roller contacting a driven roller is present.

11. The image forming apparatus according to claim 1, wherein the second guide includes an opening located near a driven roller.

12. The image forming apparatus according to claim 1, wherein the image forming apparatus body includes a cover, and the cover is opened to pull out the print medium guide unit.

13. The image forming apparatus according to claim 1, wherein the image forming apparatus body includes a drive roller, and the print medium guide unit includes a driven roller.

14. The image forming apparatus according to claim 1, wherein the image forming apparatus is capable of duplex printing, and the print medium guide unit carries the print medium that is printed on both sides of the print medium.

15. The image forming apparatus according to claim 1, wherein the image forming apparatus is capable of duplex printing, the image forming apparatus further comprises:

a first carrying path along which the print medium is carried to be printed, and a second carrying path that is parallel to the first carrying path and along which the print medium for the duplex printing is carried, and the second carrying path is formed by the print medium guide unit.

16. A medium carrying device, comprising:

an apparatus body having a side wall; and a medium guide unit that guides a print medium and that is attached to and pulled out from the apparatus body through the side wall of the apparatus body, the medium guide unit including a first guide, a second guide, and a swing axis that extends in a direction perpendicular to a medium carrying direction of the print medium between the first guide and the second guide and that connects the first guide and the second guide, wherein the second guide is swingable about the swing axis with respect to the first guide, and the swing axis is located in the vicinity of a front end of the medium guide unit in an insertion direction where the medium guide unit is inserted into the apparatus body, wherein the first guide includes a first opening in which a roller is present and a second opening in which no roller is present.

17. The medium carrying device according to claim 16, wherein the medium guide unit is pulled out from a side where the print medium is supplied to the medium guide unit.

18. The medium carrying device according to claim 16, wherein the side wall is a rear wall of the medium carrying device.

19. A medium carrying device, comprising:

an apparatus body having a side wall; and a medium guide unit that guides a print medium and that is attached to and pulled out from the apparatus body through the side wall of the apparatus body, the medium guide unit including a first guide, a second guide, and a swing axis that extends in a direction perpendicular to a medium carrying direction of the print medium between the first guide and the second guide and that connects the first guide and the second guide, wherein the second guide is swingable about the swing axis with respect to the first guide, and the swing axis is located in the vicinity of a front end of the medium guide unit in an insertion direction where the medium guide unit is inserted into the apparatus body, wherein the first guide is longer than the second guide in the medium carrying direction.

20. The medium carrying device according to claim 19, wherein the medium guide unit is pulled out from a side where the print medium is supplied to the medium guide unit.

21. The medium carrying device according to claim 19, wherein the side wall is a rear wall of the medium carrying device.

* * * * *